US008720497B2

(12) United States Patent
Meckstroth et al.

(10) Patent No.: US 8,720,497 B2
(45) Date of Patent: May 13, 2014

(54) DIRECT FILL DRY POWDER SYSTEMS WITH DOSING HEADS CONFIGURED FOR ON/OFF CONTROLLED FLOW

(75) Inventors: James R. Meckstroth, Cary, NC (US); Anthony James Hickey, Chapel Hill, NC (US)

(73) Assignee: Oriel Therapeutics, Inc., Durham, NC (US)

( * ) Notice: Subject to any disclaimer, the term of this patent is extended or adjusted under 35 U.S.C. 154(b) by 570 days.

(21) Appl. No.: 13/029,356

(22) Filed: Feb. 17, 2011

(65) Prior Publication Data

US 2011/0204094 A1 Aug. 25, 2011

Related U.S. Application Data

(60) Provisional application No. 61/306,291, filed on Feb. 19, 2010.

(51) Int. Cl.

| | |
|---|---|
| ***B65B 1/28*** | (2006.01) |
| ***B67D 7/84*** | (2010.01) |
| ***B65B 1/22*** | (2006.01) |
| ***B65D 88/66*** | (2006.01) |

(52) U.S. Cl.
CPC .. *B65B 1/22* (2013.01); *B65D 88/66* (2013.01)
USPC ..... 141/72; 222/161; 222/196

(58) Field of Classification Search
CPC ..... B65B 1/22; B67D 88/66
USPC ..... 141/72; 222/161, 196; 128/203.15
See application file for complete search history.

(56) References Cited

U.S. PATENT DOCUMENTS

| | | | | |
|---|---|---|---|---|
| 3,173,840 | A | 3/1965 | Hostetler | |
| 3,791,558 | A | 2/1974 | Katusha | |
| 3,847,191 | A | 11/1974 | Aronson | |
| 4,116,247 | A | 9/1978 | Zanasi | |
| 4,850,259 | A | 7/1989 | Morris | |
| 5,583,304 | A * | 12/1996 | Kalidindi | 73/863.56 |
| 5,865,012 | A | 2/1999 | Hansson et al. | |
| 6,065,509 | A * | 5/2000 | Bonney et al. | 141/71 |

(Continued)

FOREIGN PATENT DOCUMENTS

WO WO 97/05018 2/1997

OTHER PUBLICATIONS

International Search Report and Written Opinion for corresponding PCT application No. PCT/US2011/025355, Date of mailing Sep. 29, 2011.

*Primary Examiner* — Timothy L Maust
(74) *Attorney, Agent, or Firm* — Myers Bigel Sibley & Sajovec, P.A.

(57) ABSTRACT

Apparatus for dispensing a defined amount of dry powder concurrently to a plurality of spaced apart dose receiving containers include: (a) a dosing head comprising a support body with a plurality of spaced apart elongate channels having a channel length with an upper end defining an entry orifice and a lower end defining an exit port; (b) a dry powder bed residing above and in communication with the dosing head; and (c) at least one vibration source in communication with the dosing head channels configured to controllably apply a vibration flow signal, wherein, when the vibration flow signal is applied to the dosing head channels, dry powder from the dry powder bed flows through the elongate channels and out the exit port and when the flow signal is removed, dry powder does not flow through the dosing head elongate channels.

24 Claims, 34 Drawing Sheets

(56) References Cited

U.S. PATENT DOCUMENTS

| | | | | |
|---|---|---|---|---|
| 6,223,953 | B1 * | 5/2001 | Arslanouk et al. | 222/161 |
| 6,226,962 | B1 | 5/2001 | Eason et al. | |
| 6,267,155 | B1 | 7/2001 | Parks et al. | |
| 6,357,490 | B1 | 3/2002 | Johnston et al. | |
| 6,886,612 | B2 | 5/2005 | Duffield | |
| 6,985,798 | B2 * | 1/2006 | Crowder et al. | 700/240 |
| 7,118,010 | B2 | 10/2006 | Crowder et al. | |
| 7,868,260 | B2 * | 1/2011 | MacMichael et al. | 177/108 |
| 8,191,587 | B2 * | 6/2012 | Luechinger et al. | 141/77 |
| 2004/0060265 | A1 | 4/2004 | Boeckle et al. | |
| 2005/0040185 | A1 | 2/2005 | Macmichael et al. | |
| 2009/0014086 | A1 | 1/2009 | Macmichael et al. | |

* cited by examiner

DIRECT FILL DRY POWDER SYSTEMS WITH DOSING HEADS CONFIGURED FOR ON/OFF CONTROLLED FLOW

RELATED APPLICATIONS

This application claims the benefit of and priority to U.S. Provisional Patent Application Ser. No. 61/306,291, filed Feb. 19, 2010, the contents of which are hereby incorporated by reference as if recited in full herein.

FIELD OF THE INVENTION

The present invention relates to systems for filling containers with dry powder such as drugs, chemicals and toners and may be particularly suitable for filling multi-dose disks or other containers for dry powder inhalers.

BACKGROUND OF THE INVENTION

Known dry powder dose filling devices use injectors, pistons or sleeves, such as described in U.S. Pat. Nos. 3,847,191, 4,116,247, 4,850,259, and 6,886,612. Despite the above, there remains a need for alternate dose filling systems.

SUMMARY OF EMBODIMENTS OF THE INVENTION

Embodiments of the invention provide dosing heads with a plurality of spaced apart elongate channels that communicate with a dry powder bed to concurrently directly fill a plurality of aligned dose containers.

Embodiments of the invention provide a relatively high-speed filling process for concurrently filling all the dose containers held by a dose container member, such as a disk, in sub-second time.

In some embodiments, the dosing head has at least one row of circumferentially spaced apart elongate channels (e.g., 30) and can directly fill an underlying dose container disk with an aligned row of spaced apart concentric dose containers (typically in less than about 1 second). In particular embodiments, the dosing head has two radially spaced apart circular rows of elongate channels, e.g., two rows of 30 channels arranged in a circle.

The dosing head can include at least one plate that provides the elongate channels. The dosing head can be configured to interchangeably hold different plates with different elongate channel geometries for accommodating specific dose container form factors and/or for use with different dry powder formulations. The dosing head plate can be substantially circular.

The dosing systems can be configured to fill a dose container disk with 30, 60 or, in particular embodiments, even 120 dose containers in less than about 1 second.

Some embodiments are directed to an apparatus for dispensing a defined amount of dry powder concurrently to a plurality of spaced apart dose receiving containers. The apparatus includes: (a) a dosing head comprising a support body with a plurality of spaced apart elongate channels having a channel length with an upper end defining an entry orifice and a lower end defining an exit port; (b) a dry powder bed residing above and in communication with the dosing head; and (c) at least one vibration source in communication with the dosing head channels configured to controllably apply a vibration flow signal. The channels are sized and configured to prevent a free-flow of dry powder therefrom. When the vibration flow signal is applied to the dosing head channels, dry powder from the dry powder bed flows through the elongate channels and out of the exit port. When the vibration flow signal is removed, dry powder does not flow through the dosing head elongate channels.

The spaced apart channels can be arranged so that the respective entry orifices are substantially circumferentially spaced apart in at least one circle. In some particular embodiments, the channel entry orifices are arranged in two substantially concentric circles.

The vibration source can include a substantially cylindrical body actuator mechanism with a radially extending flange having an array of circumferentially extending apertures extending therethrough. The apparatus can further include a tube plate with an array of upwardly extending tubes having upper and lower ends. The tube plate can be positioned between the actuator body flange and the dose head body so that each tube extends through a respective flange aperture with upper ends of the tubes in communication with dry powder in a dry powder hopper and lower ends of the tubes residing proximate the dosing head channels.

The channels can have orifices that have a diameter of about 3 mm or less and a geometry that defines a miniature-hopper selected to provide an on/off flow pattern and mass flow rate to deliver a defined dose amount in the range of between about 0.5-15 mg.

The channels can be sloped along at least a major portion of the channel length. For example, the channels can slope downward at an angle that is between about 30 degrees to about 45 degrees for at least a major portion of the length of the channel. The channels may have a first portion that angles downwardly to merge into a second portion that is substantially vertical at the exit port.

In some embodiments, the dosing head includes a holder with upstanding sidewalls and a lower inwardly extending ledge. The dosing head can include a plate that mounts to the holder and resides on the ledge and the plate defines the channels. In some embodiments, the dosing head includes at least one substantially circular plate that defines the channels, the plate having a center. The apparatus can include an upstanding rod that is aligned with the center of the plate. The rod is in communication with the plate and the vibration source to apply the vibration flow signal to the plate.

In some embodiments, the apparatus includes a substantially circular tube plate with an array of circumferentially spaced apart tubes. The dosing head body can be defined by a substantially circular orifice plate that includes at least one row of circumferentially spaced apart elongate channels. The vibration source can include an actuator mechanism with a substantially cylindrical body with a vertically extending centerline aligned with a vertical linear vibration axis of the orifice plate. The actuator mechanism can have a radially extending flange that is attached to the orifice plate and the tube plate. The actuator mechanism can include a plurality of linear actuators that cause the tubes to vibrate in a vertical direction to feed dry powder to the orifice plate and to apply the vibration signal to the orifice plate.

The dosing head can have a lower primary surface that is horizontally oriented. The vibration source can be substantially in-line with a vertical axis associated with the dosing head and is configured to apply energy so that the dosing head operates with a vertical displacement that is less than about 100 microns, and wherein the target dose container is a disk that is closely spaced apart from a lowermost surface of the dosing head.

The vibration source can include: (a) a plurality of actuators, one residing proximate each channel to individually apply the flow signal; (b) a single actuator that is configured to apply the flow signal to all the flow channels; or (c) a plurality of actuators, at least one for sub-groupings of the channels.

The dry powder bed can hold a dry powder having a pharmaceutically active agent including, but not limited to, bronchodilators and the bronchodilator may be used in the form of salts, esters or solvates to thereby optimize the activity and/or stability of the medicament.

The dosing head can include at least one plate that defines at least some of the channels, and wherein the dosing head is configured to releasably engage different plates having different channel geometries to thereby allow a user to dispense different dry powders.

The apparatus channels communicate with the dry powder bed to define miniature hoppers that each hold a plurality of bolus amounts of dry powder and controllably directly dispense a bolus amount to an aligned dose container in response to the on and off application of the vibration flow signal.

Other embodiments are directed to methods of filling a dose container disk assembly. The methods include: (a) providing a dose container disk having upper and lower primary surfaces with a plurality of circumferentially spaced apart apertures associated with dose containers; (b) placing the dose container disk under a dosing head that resides below a dry powder bed, the dosing head having a plurality of circumferentially spaced apart dose filling channels with respective exit ports over the dose container disk so that the exit ports are aligned with the dose disk apertures; (c) applying a vibration flow signal to the dosing head to cause the dry powder to concurrently flow out of the channels into the dose disk apertures; (d) directly filling the dose container disk with a defined amount of dry powder in response to the applying step; and (e) ceasing the applying step to stop the flow of dry powder thereby filling a dose container disk with a defined amount of dry powder in each of the dose containers.

The flow vibration signal can be in-line and can be a frequency modified (modulated) signal. The dose container disk can have at least 30 apertures and the dosing head has at least 30 dose filling channels, and the filling step is carried out to fill at least 30 dose containers on a disk or other substrate in less than 1 second, typically in less than 0.5 seconds.

The dosing head can be attached to a tube plate that includes an array of upwardly extending tubes that communicate with the dry powder bed. The applying step can be carried out to also cause the tubes to vibrate up and down to feed the dosing head channels (which may optionally reside in a lower orifice plate).

Yet other embodiments are directed to dosing heads for a powder filling system that include a plurality of circumferentially spaced apart filling channels with exit ports residing on inner and outer radially spaced apart rows.

The dosing head can include a circular orifice plate that holds the filling channels.

The dosing head can be in combination with a tube plate attached to the orifice plate and an actuator mechanism with a radially extending flange with an array of apertures attached to the tube plate and the orifice plate.

The tube plate can have upper and lower planar surfaces with the upper surface having at least one row of upwardly extending circumferentially spaced apart tubes positioned so that the upwardly extending tubes of the tube plate extend through the flange apertures and the tube plate resides between the orifice plate and the actuator flange.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE FIGURES

FIG. 5E is a perspective partial cutaway view of the dosing head shown in

FIG. 5C.

DESCRIPTION OF EMBODIMENTS OF THE INVENTION

Figure 1:
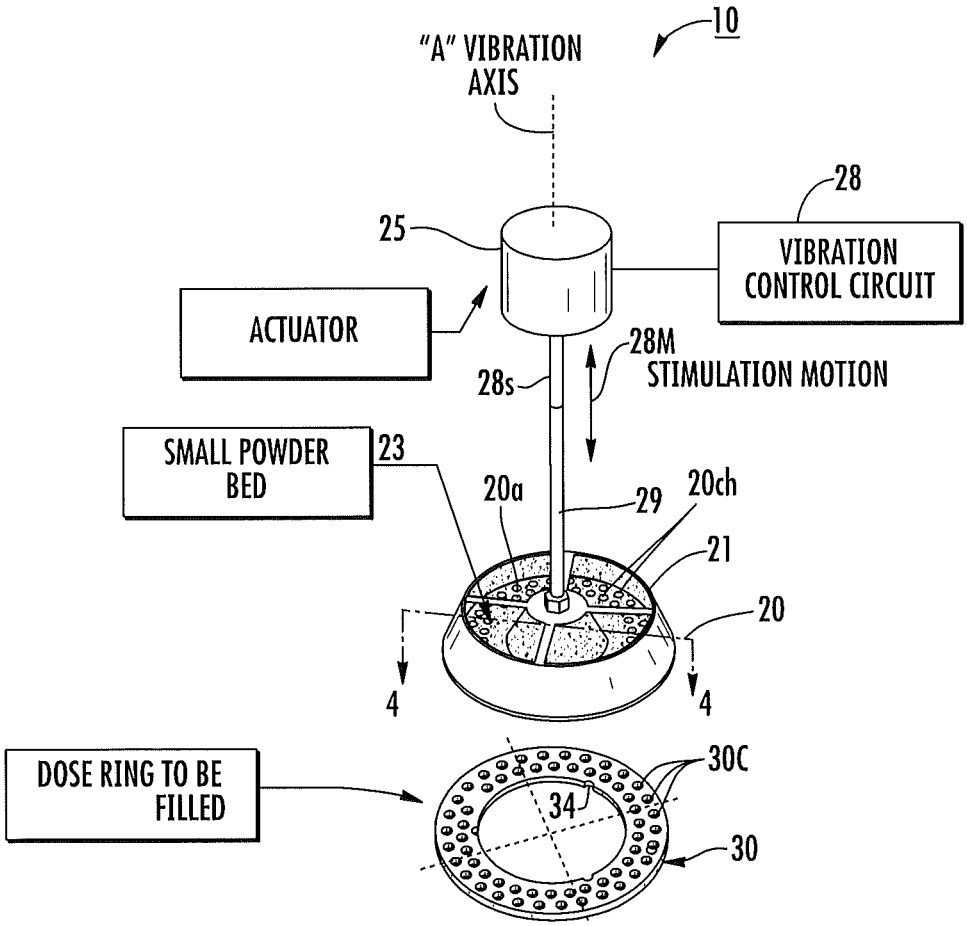
FIG. 1 is a side perspective view of a filling system according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise. Features described with respect to one figure or embodiment can be associated with another embodiment of figure although not specifically described or shown as such.

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation or relative descriptor only unless specifically indicated otherwise.

It will be understood that although the terms "first" and "second" are used herein to describe various components, regions, layers and/or sections, these regions, layers and/or sections should not be limited by these terms. These terms are only used to distinguish one component, region, layer or section from another component, region, layer or section. Thus, a first component, region, layer or section discussed below could be termed a second component, region, layer or section, and vice versa, without departing from the teachings of the present invention. Like numbers refer to like elements throughout.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

In the description of the present invention that follows, certain terms are employed to refer to the positional relationship of certain structures relative to other structures. As used herein, the term "front" or "forward" and derivatives thereof refer to the general or primary direction that the dry powder travels from a powder bed to a receiving container such as a dose disk; this term is intended to be synonymous with the term "downstream," which is often used in manufacturing or material flow environments to indicate that certain material traveling or being acted upon is farther along in that process than other material. Conversely, the terms "rearward" and "upstream" and derivatives thereof refer to the direction opposite, respectively, the forward or downstream direction.

The term "deagglomeration" and its derivatives refer to flowing or processing dry powder to inhibit the dry powder from remaining or becoming agglomerated or cohesive.

The term "free-flow" refers to the ability of a channel to allow dry powder to flow therethrough when in an operative position and in the absence of any vibratory flow signal.

The filling systems can be particularly suitable for filling a partial or bolus dose or doses of one or more types of particulate dry powder substances that are formulated for in vivo inhalant dispersion (using an inhaler) to subjects, including, but not limited to, animal and, typically, human subjects. The inhalers can be used for nasal and/or oral (mouth) respiratory inhalation delivery, but are typically oral inhalers.

The terms "sealant", "sealant layer" and/or "sealant material" includes configurations that have at least one layer of at least one material and can be provided as a continuous layer that covers the entire upper surface and/or lower surface or may be provided as strips or pieces to cover portions of the device, e.g., to reside over at least one or more of the dose container apertures. Thus, terms "sealant" and "sealant layer" include single and multiple layer materials, typically comprising at least one foil layer. The sealant or sealant layer can be a thin multi-layer laminated sealant material with elastomeric and foil materials. The sealant layer can be selected to provide drug stability as they may contact the dry powder in the respective dose containers.

The sealed dose containers can be configured to inhibit oxygen and moisture penetration to provide a sufficient shelf life.

The term "primary surface" refers to a surface that has a greater area than another surface and the primary surface can be substantially planar or may be otherwise configured. For example, a primary surface can include protrusions or recesses, such as where some blister configurations are used. Thus, a component such as a disk and/or plate can have upper and lower primary surfaces and a minor surface (e.g., a wall with a thickness) that extends between and connects the two.

The dry powder substance may include one or more active pharmaceutical constituents as well as biocompatible additives that form the desired formulation or blend. As used herein, the term "dry powder" is used interchangeably with "dry powder formulation" and means that the dry powder can comprise one or a plurality of constituents, agents or ingredients with one or a plurality of (average) particulate size ranges. The term "low-density" dry powder means dry powders having a density of about 0.8 g/cm$^3$ or less. In particular embodiments, the low-density powder may have a density of about 0.5 g/cm$^3$ or less. The dry powder may be a dry powder with cohesive or agglomeration tendencies.

The term "filling" means providing a bolus or sub-bolus metered or defined amount of dry powder. Thus, the respective dose container is not required to be volumetrically full.

The term "direct" with respect to filling means that no additional components are required to carry out the operation, e.g., the dry powder is directly deposited from the dosing head channel into a blister or other dose container.

As will be appreciated by one of skill in the art, embodiments or aspects of the invention may be embodied as a method, system, data processing system, or computer program product. Accordingly, the present invention may take the form of an entirely software embodiment or an embodiment combining software and hardware aspects, all generally referred to herein as a "circuit" or "module."

In any event, individual dispensable quantities of dry powder formulations can comprise a single ingredient or a plurality of ingredients, whether active or inactive. The inactive ingredients can include additives added to enhance flowability or to facilitate aerosolization delivery to the desired target. The dry powder drug formulations can include active particulate sizes that vary. The systems may be particularly suitable for filling dry powder formulations having particulates which are in the range of between about 0.5-50 μm, typically in the range of between about 0.5 μm-20.0 μm, and more typically in the range of between about 0.5 pm-8.0 μm. The dry powder formulation can also include flow-enhancing ingredients, which typically have particulate sizes that may be larger than the active ingredient particulate sizes. In certain embodiments, the flow-enhancing ingredients can include excipients having particulate sizes on the order of about 50-100 μm. Examples of excipients include lactose and trehalose. Other types of excipients can also be employed, such as, but not limited to, sugars which are approved by the United States Food and Drug Administration ("FDA") as cryoprotectants (e.g., mannitol) or as solubility enhancers (e.g., cyclodextrine) or other generally recognized as safe ("GRAS") excipients.

"Active agent" or "active ingredient" as described herein includes an ingredient, agent, drug, compound, or composition of matter or mixture, which provides some pharmacologic, often beneficial, effect. This includes foods, food supplements, nutrients, drugs, vaccines, vitamins, and other beneficial agents. As used herein, the terms further include any physiologically or pharmacologically active substance that produces a localized and/or systemic effect in a patient.

The active ingredient or agent that can be delivered includes antibiotics, antiviral agents, anepileptics, analgesics, anti-inflammatory agents and bronchodilators, and may be inorganic and/or organic compounds, including, without limitation, drugs which act on the peripheral nerves, adrenergic receptors, cholinergic receptors, the skeletal muscles, the cardiovascular system, smooth muscles, the blood circulatory system, synoptic sites, neuroeffector junctional sites, endocrine and hormone systems, the immunological system, the reproductive system, the skeletal system, autacoid systems, the alimentary and excretory systems, the histamine system, and the central nervous system. Suitable agents may be selected from, for example and without limitation, polysaccharides, steroids, hypnotics and sedatives, psychic energizers, tranquilizers, anticonvulsants, muscle relaxants, anti-Parkinson agents, analgesics, anti-inflammatories, muscle contractants, antimicrobials, antimalarials, hormonal agents including contraceptives, sympathomimetics, polypeptides and/or proteins (capable of eliciting physiological effects), diuretics, lipid regulating agents, antiandrogenic agents, antiparasitics, neoplastics, antineoplastics, hypoglycemics, nutritional agents and supplements, growth supplements, fats, antienteritis agents, electrolytes, vaccines and diagnostic agents.

The active agents may be naturally occurring molecules or they may be recombinantly produced, or they may be analogs of the naturally occurring or recombinantly produced active agents with one or more amino acids added or deleted. Further, the active agent may comprise live attenuated or killed viruses suitable for use as vaccines. Where the active agent is insulin, the term "insulin" includes natural extracted human insulin, recombinantly produced human insulin, insulin extracted from bovine and/or porcine and/or other sources, recombinantly produced porcine, bovine or other suitable donor/extraction insulin and mixtures of any of the above. The insulin may be neat (that is, in its substantially purified form), but may also include excipients as commercially formulated. Also included in the term "insulin" are insulin analogs where one or more of the amino acids of the naturally occurring or recombinantly produced insulin has been deleted or added.

It is to be understood that more than one active ingredient or agent may be incorporated into the aerosolized active agent formulation and that the use of the term "agent" or "ingredient" in no way excludes the use of two or more such agents. Indeed, some embodiments of the present invention contemplate filling a single dose container or a single disk with combination drugs that may be mixed in situ.

Examples of diseases, conditions or disorders that may be treated using dry powder filled with the filling systems of embodiments of the invention include, but are not limited to, asthma, COPD (chronic obstructive pulmonary disease), viral or bacterial infections, influenza, allergies, cystic fibrosis, and other respiratory ailments as well as diabetes and other insulin resistance disorders. The dry powder may be used to deliver locally-acting agents such as antimicrobials, protease inhibitors, and nucleic acids/oligionucleotides as well as systemic agents such as peptides like leuprolide and proteins such as insulin. For example, inhaler-based delivery of antimicrobial agents such as antitubercular compounds, proteins such as insulin for diabetes therapy or other insulin-resistance related disorders, peptides such as leuprolide acetate for treatment of prostate cancer and/or endometriosis and nucleic acids or ogligonucleotides for cystic fibrosis gene therapy may be performed. See e.g. Wolff et al., *Generation of Aerosolized Drugs*, J. Aerosol. Med. pp. 89-106 (1994). See also U.S. Patent Application Publication No. 20010053761, entitled *Method for Administering ASPB28-Human Insulin* and U.S. Patent Application Publication No. 20010007853, entitled *Method for Administering Monomeric Insulin Analogs*, the contents of which are hereby incorporated by reference as if recited in full herein.

Typical dose amounts of the unitized dry powder mixture dispersed by inhalers may vary depending on the patient size, the systemic target, and the particular drug(s). The dose amounts and type of drug held by a dose container (also known as a "dose container system") may vary per dose container or may be the same on a platform such as a disk. In some embodiments, the dry powder dose amounts can be about 100 mg or less, typically less than 50 mg, and more typically between about 0.1 mg to about 30 mg.

In some embodiments, such as for pulmonary conditions (i.e., asthma or COPD), the dry powder can be provided as about 5 mg total weight (the dose amount may be blended to provide this weight). A conventional exemplary dry powder dose amount for an average adult is less than about 50 mg, typically between about 10-30 mg and for an average adolescent pediatric subject is typically from about 5-10 mg. A typical dose concentration may be between about 1-5%. Exemplary dry powder drugs include, but are not limited to, albuterol, fluticasone, beclamethasone, cromolyn, terbutaline, fenoterol, (3-agonists (including long-acting (3-agonists), salmeterol, formoterol, cortico-steroids and glucocorticoids.

In certain embodiments, the bolus or dose can be formulated with an increase in concentration (an increased percentage of active constituents) over conventional blends. Further, the dry powder formulations may be configured as a smaller administrable dose compared to the conventional 10-25 mg doses. For example, each administrable dry powder dose may be on the order of less than about 60-70% of that of conventional doses. In certain particular embodiments, using the dispersal systems provided by certain embodiments of the DPI configurations of the instant invention, the adult dose may be reduced to under about 15 mg, such as between about 10 μg-10 mg, and more typically between about 50 μg-10 mg. The active constituent(s) concentration may be between about 5-10%. In other embodiments, active constituent concentrations can be in the range of between about 10-20%, 20-25%, or even larger. In particular embodiments, such as for nasal inhalation, target dose amounts may be between about 12-100 μg.

In certain particular embodiments, the dry powder in the filling system for a particular dose container, drug compartment or blister may be formulated in high concentrations of an active pharmaceutical constituent(s) substantially without additives (such as excipients). As used herein, "substantially without additives" means that the dry powder is in a substantially pure active formulation with only minimal amounts of other non-biopharmacological active ingredients. The term "minimal amounts" means that the non-active ingredients may be present, but are present in greatly reduced amounts, relative to the active ingredient(s), such that they comprise less than about 10%, and preferably less than about 5%, of the dispensed dry powder formulation, and, in certain embodiments, the non-active ingredients are present in only trace amounts.

In some embodiments, the target unit dose amount of dry powder for a respective drug compartment or dose container is between about 5-15 mg, typically less than about 10 mg, such as about 5 mg of blended drug and lactose or other additive (e.g., 5 mg LAC), for treating pulmonary conditions such as asthma. Insulin may be provided in quantities of about 4 mg or less, typically about 3.6 mg of pure insulin. The dry powder may be inserted into a dose container/drug compartment in a "compressed" or partially compressed manner or may be provided as free flowing particulates.

The filling can be carried out to fill dose containers in any suitable number of doses, typically between about 30-120 doses, and more typically between about 30-60 doses.

Certain embodiments may be particularly suitable for dispensing medication to respiratory patients, diabetic patients, cystic fibrosis patients, or for treating pain. The inhalers may also be used to dispense narcotics, hormones and/or infertility treatments.

The dose filling systems may be particularly suitable for dispensing medicament for the treatment of respiratory disorders. Appropriate medicaments may be selected from, for example, analgesics, e.g., codeine, dihydromorphine, ergotamine, fentanyl or morphine; anginal preparations, e.g., diltiazem; antiallergics, e.g., cromoglycate, ketotifen or nedocromil; antiinfectives e.g., cephalosporins, penicillins, streptomycin, sulphonamides, tetracyclines and pentamidine; antihistamines, e.g., methapyrilene; anti-inflammatories, e.g., beclomethasone dipropionate, fluticasone propionate, flunisolide, budesonide, rofleponide, mometasone furoate or triamcinolone acetonide; antitussives, e.g., noscapine; bronchodilators, e.g., albuterol, salmeterol, ephedrine, adrenaline, fenoterol, formoterol, isoprenaline, metaproterenol, phenylephrine, phenylpropanolamine, pirbuterol, reproterol, rimiterol, terbutaline, isoetharine, tulobuterol, or (−)-4-amino-3, 5-dichloro-α-[[6-[2-(2-pyridinyl) ethoxy] hexyl] methyl] benzenemethanol; diuretics, e.g., amiloride; anticholinergics, e.g., ipratropium, tiotropium, atropine or oxitropium; hormones, e.g., cortisone, hydrocortisone or prednisolone; xanthines, e.g., aminophylline, choline theophyllinate, lysine theophyllinate or theophylline; therapeutic proteins and peptides, e.g., insulin or glucagon. It will be clear to a person of skill in the art that, where appropriate, the medicaments may be used in the form of salts, (e.g., as alkali metal or amine salts or as acid addition salts) or as esters (e.g., lower alkyl esters) or as solvates (e.g., hydrates) to optimize the activity and/or stability of the medicament.

Some particular embodiments of the filling system can be used to dispense meted quantities of medicaments that are selected from the group consisting of:

albuterol, salmeterol, fluticasone propionate and beclometasone dipropionate and salts or solvates thereof, e.g., the sulphate of albuterol and the xinafoate of salmeterol. Medicaments can also be delivered in combinations. Examples of particular formulations containing combinations of active ingredients include those that contain salbutamol (e.g., as the free base or the sulphate salt) or salmeterol (e.g., as the xinafoate salt) in combination with an anti-inflammatory steroid such as a beclomethasone ester (e.g., the dipropionate) or a fluticasone ester (e.g., the propionate).

Figure 2A:
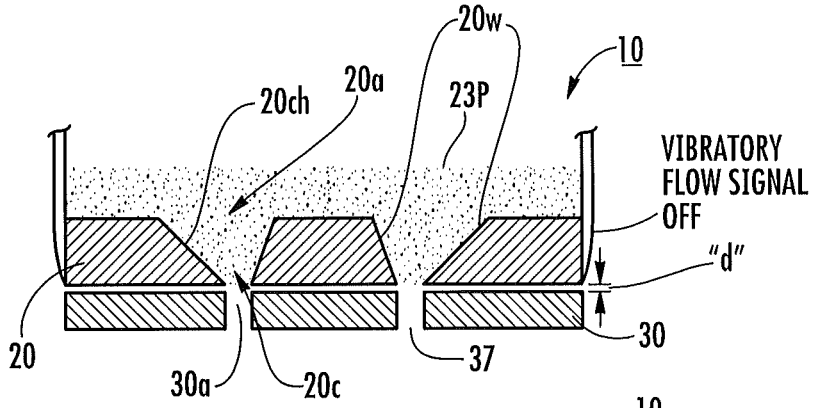
FIGS. 2A and 2B are schematic cross-sectional views of a dose filling head and aligned dose containers for filling according to embodiments of the present invention.

Turning now to the figures, FIG. 1 illustrates an example of a filling system 10. The filling system 10 includes a dosing head 20 with a plurality of spaced apart dosing channels 20*ch*. A dry powder bed 23 with dry powder 23*p* (FIG. 2A) resides above the channels 20*ch*. The channels 20*ch* all include inlet orifices 20*a* and opposing exit ports 20*e* and sidewalls 20*w* (FIG. 2A). The filling system 10 includes a vibration source 25 that is in communication with the channels 20*ch*. The vibration source 25 communicates with a vibratory control circuit 28 to generate a defined vibration flow signal 28*s* which is transmitted to the dry powder channels 20*ch* for a defined time to cause dry powder 23*p* to flow out of the dosing channels 20*ch* and into aligned dose containers 30*c* to dispense a metered amount of the dry powder therein. The flow signal 28*s* can generate a small stimulation motion 28M, typically in-line (e.g., substantially vertical) with a suitable displacement profile as will be discussed further below.

The geometry of the channel 20*ch*, including one or more of the size of the orifice 20*a*, size (volume and cross-sectional area) of the channel between entry orifice 20*a* and the exit port 20*e*, shape and length of the channel and the size and shape of the exit port can be selected so that there is no "free flow" of powder out of the exit port 20*e* when dispensing is not desired (e.g., when the vibratory flow signal is "off" or not transmitted to the flow channels).

The channel geometry and the flow signal 28*s* can be selected to define a reliable flow rate with the "on" and "off" flow control corresponding to when the flow signal is applied or withheld without requiring any physical barrier or valving of the exit ports 20*e*. The flow rates can be within a range of between about 5 mg/second to about 100 mg/second, typically between about 10 mg/second to about 30 mg/second. It may be desired to have the channel geometry and the vibration provide a sub-second filling rate, e.g., a suitable flow rate for an "on" time for the vibratory flow signal of less than about 1 second, typically about 0.5 seconds or less to fill all 30 or 60 doses (or other numbers of dose containers).

Figure 2B:
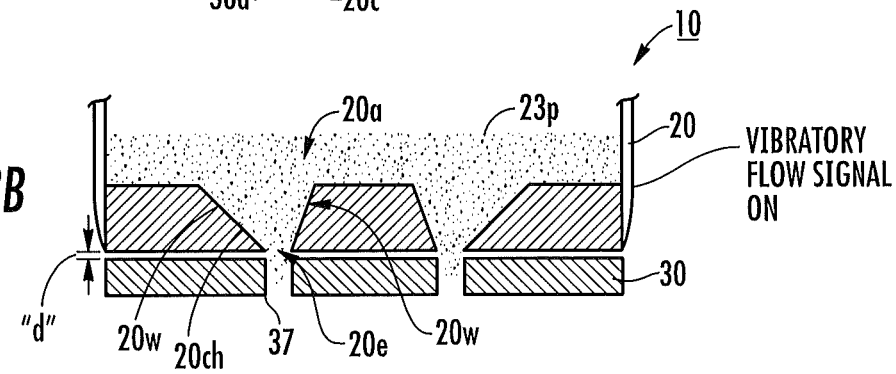

As shown in FIGS. 2A and 2B, during filling, the dosing head 20 can reside closely spaced apart from (but not contacting) an underlying dose container member 30 with a plurality of spaced apart dose containers 30*c*. The spacing can be at distance "d", typically between about 0.1 mm to about 2.0 mm, and may, in some particular embodiments be between about 0.5 mm to about 1.0 mm.

Figure 5A:
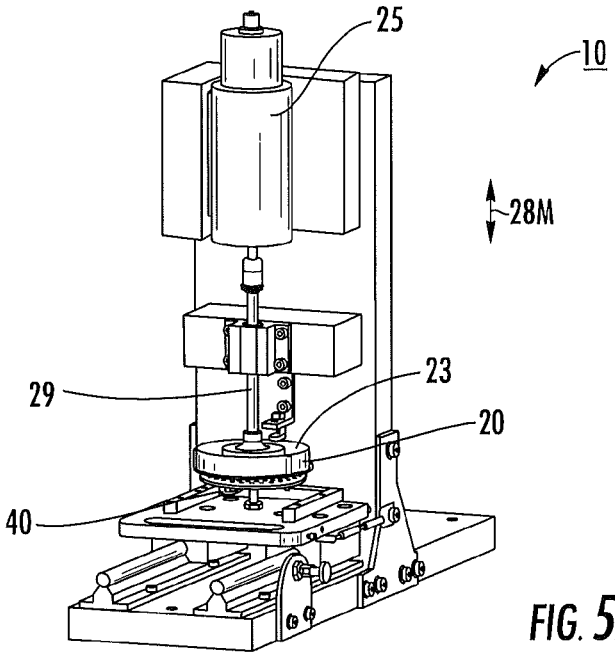
FIG. 5A is a perspective view of a filling system according to embodiments of the present invention.
Figure 5B:
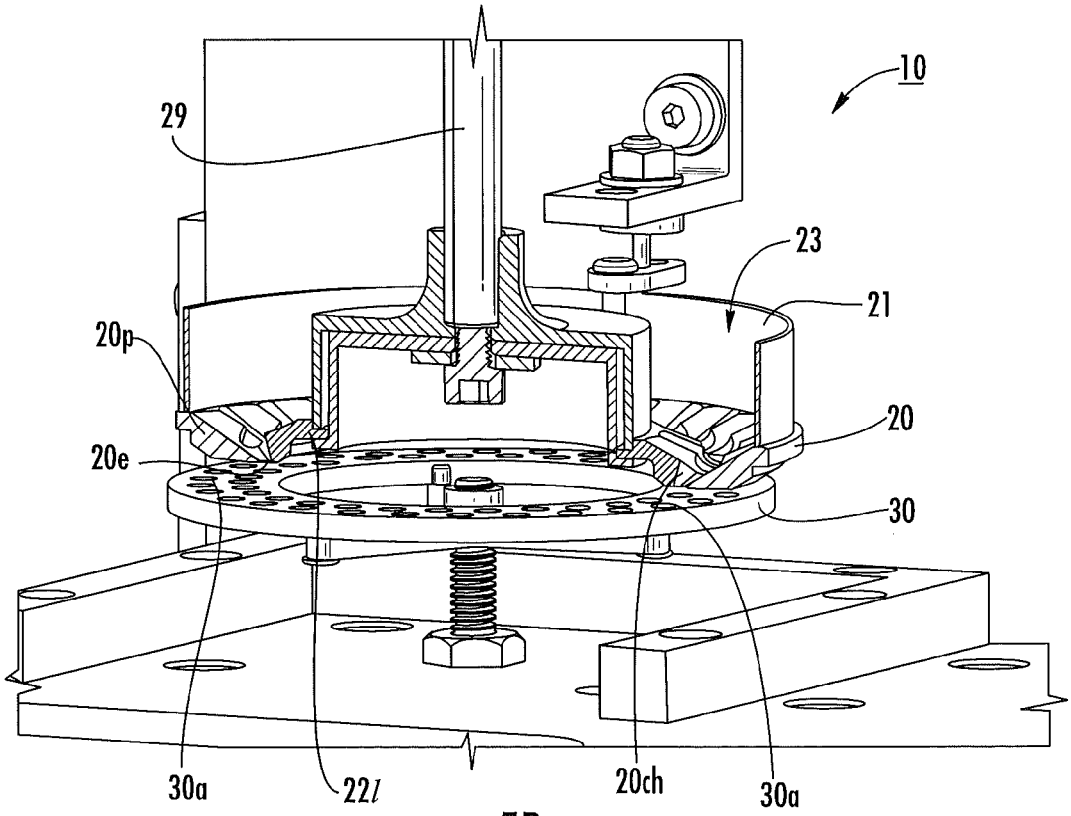
FIG. 5B is a partial cutaway view of the filling system shown in FIG. 5A.

FIGS. 5A and 5B illustrate another example of a filling system 10. As shown in FIG. 5B, the dosing head 20 resides closely spaced to the dose container 30. FIG. 5B also illustrates that the channels 20*ch* are held aligned with/registered to a corresponding dose container aperture 30*a*.

The dry powder bed 23 with the dry powder 23*p* can be enclosed in a housing or open to atmosphere but is not required to be sealed in a pressurized chamber. That is, as the geometry of the channel and the vibratory flow signal directly dispense the dry powder into aligned dose containers 30*c*. The system 10 does not require either pressure or vacuum to dispense the dry powder and the dry powder bed can be environmentally protected from exposure but is not sealed in a pressure-tight manner.

Referring to FIG. 2A, as shown, before or after active dispensing (FIG. 2B), at least one bolus quantity of the dry powder can reside in the dose channel 20*ch*. In this way, the channels 20*ch* act as miniature hoppers of one or a few dose quantities of the dry powder 23. In other embodiments, the dry powder 23*p* remains in the powder bed 23 above the channels 20*ch* and the dry powder only enters and flows through the channels when the flow signal 28*s* is applied to the dosing head 20 and/or channels 20*ch*. The latter operational configuration may be particularly true for some channel geometries, such as those with very small entry orifices or those having inverted funnel shapes (where the smallest orifice of the channel is at the top of the device in contact with the powder bed), for example.

The dry powder 23*p* in the channel can be replenished via a powder bed residing directly above the channels 20*ch* (contacting the upper primary surface the dosing head 20 and the entry orifices 20*a*). The powder 23*p* in the powder bed 23 can be maintained at a desired level or may be allowed to fluctuate in levels, typically between defined upper and lower limits, such as between a 3 mm to a 150 mm bed height above the entry orifices 20*a*, typically between 3 mm and 15 mm. The powder 23*p* in the powder bed 23 can be continuously replenished or may be replenished based on a level sensor and/or after a defined number of dose container members 20 have been filled.

In particular embodiments, the channels 20*ch* can be sloped and/or angled to inhibit "rat-holing" or undesired trapping of the dry powder. Rat-holing refers to circumstances in which powder is retained against the walls of a length of the channel. Bridging and rat-holing can both be caused by a reduction in the channel width or cross sectional area. This may lead to the powder becoming compacted and forming stresses within the body of the powder. These stresses can lead to stable structures that are difficult to break up. This problem is usually amplified by high wall friction and a head of powder above the blockage. Although vibration can be used to break a bridge or to cause a rat hole to collapse, it can also have the adverse effect of compacting the powder.

Figure 9B:
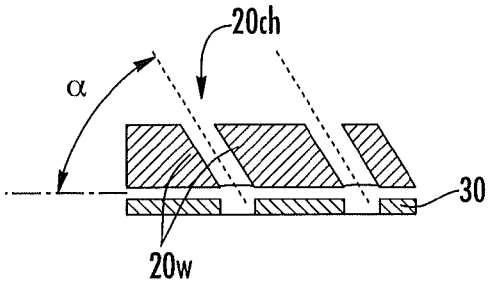
FIG. 9B is a schematic fragmented sectional view of a dosing channel with an alternate sloping geometry and aligned dose container member according to embodiments of the present invention.
Figure 9A:
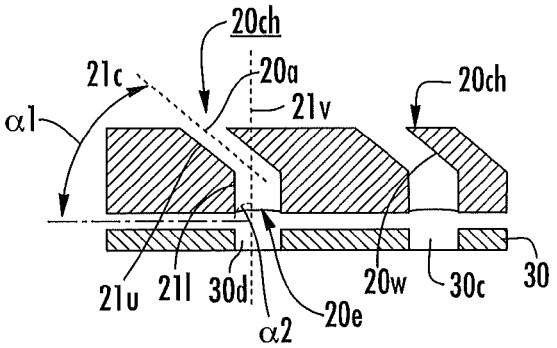
FIG. 9A is a schematic fragmented sectional view of a dosing channel with a sloping geometry and aligned dose container member according to embodiments of the present invention.

To facilitate controlled flow, in some embodiments, as shown in FIG. 9A (and FIGS. 17A and 17B), the channels 20*ch* can have an angle (e.g., slope) for a least a major portion of the length of the channel. The angle "α" can be defined with the slope of the wall defining the channel flow floor for the powder and/or with respect to the longitudinally extending centerline of the channel. The angle "α" can be between about 30 degrees to about 75 degrees from horizontal, and more typically is between about 30 degrees to about 45 degrees, such as about 40 or 41 degrees from horizontal.

Figure 22A:
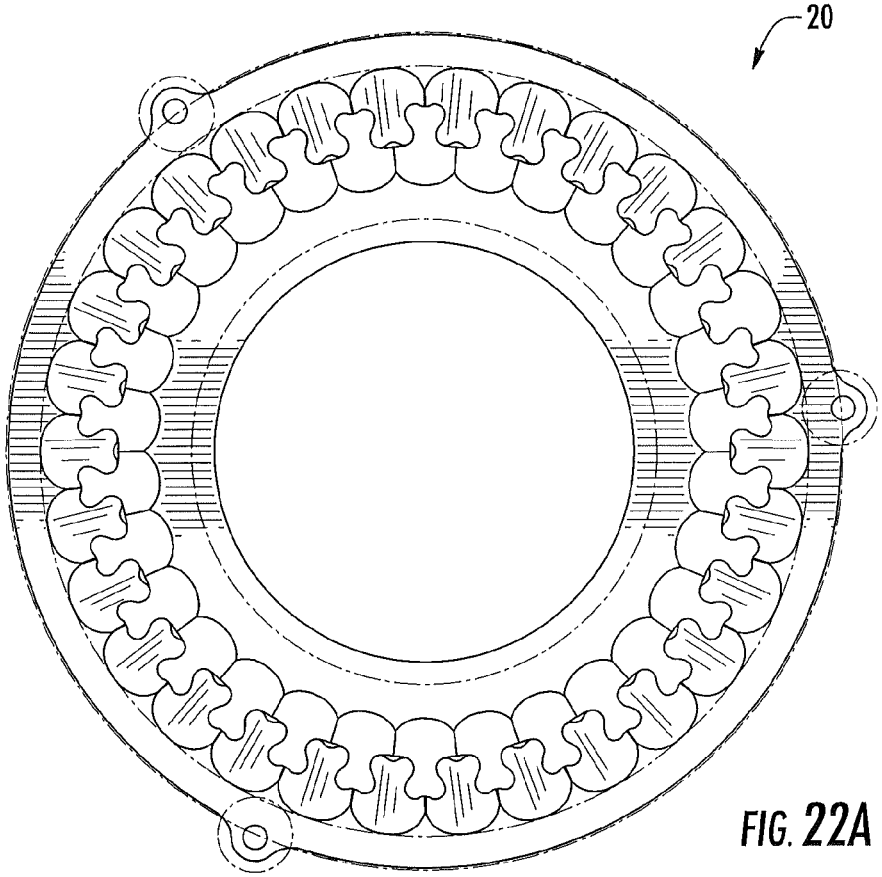
FIG. 22A is a top view of another embodiment of a dosing head with alternating inward and outward sloping channels according to embodiments of the present invention.
Figure 22B:
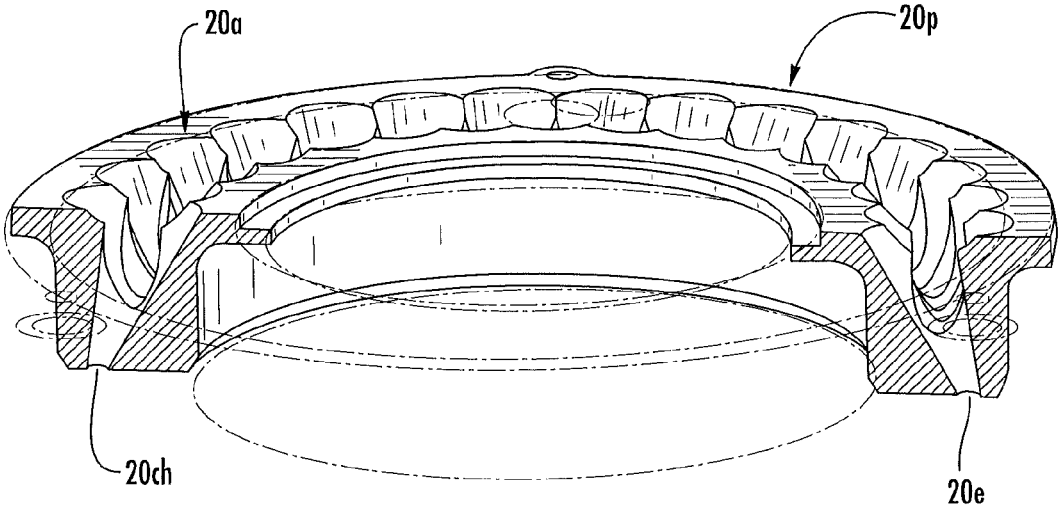
FIG. 22B is a side perspective cutaway view of the device shown in FIG. 22A.
Figure 22C:
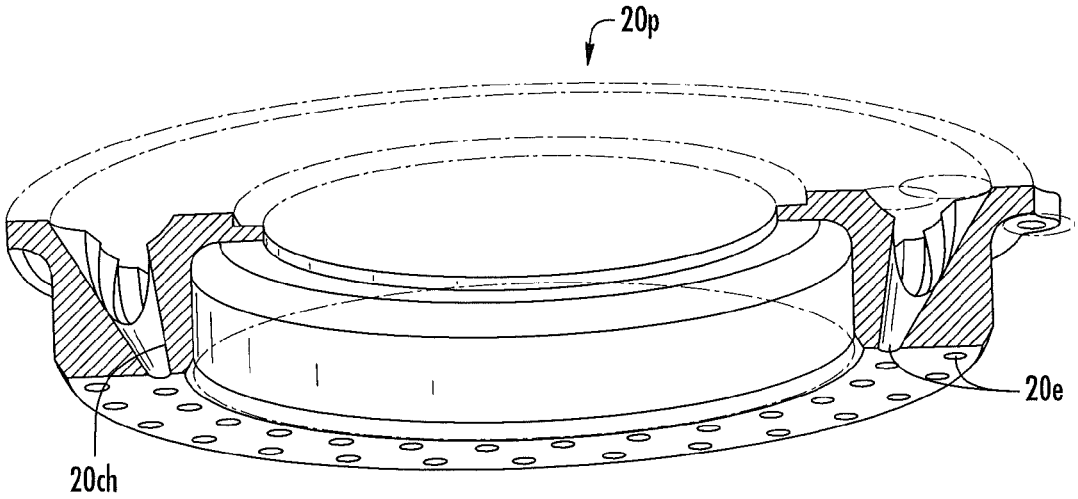
FIG. 22C is a bottom perspective view of the device shown in FIG. 22A.
Figure 23A:
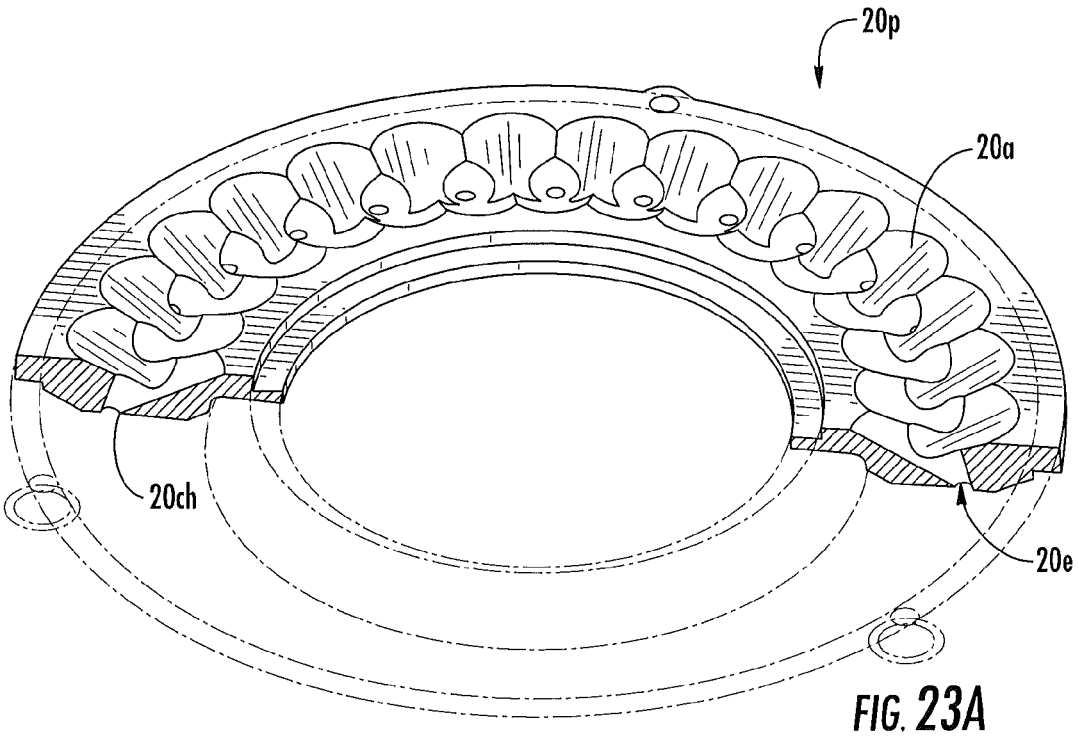
FIG. 23A is a cutaway view of yet another embodiment of a dosing head with alternating inward and outward sloping channels according to embodiments of the present invention.
Figure 23B:
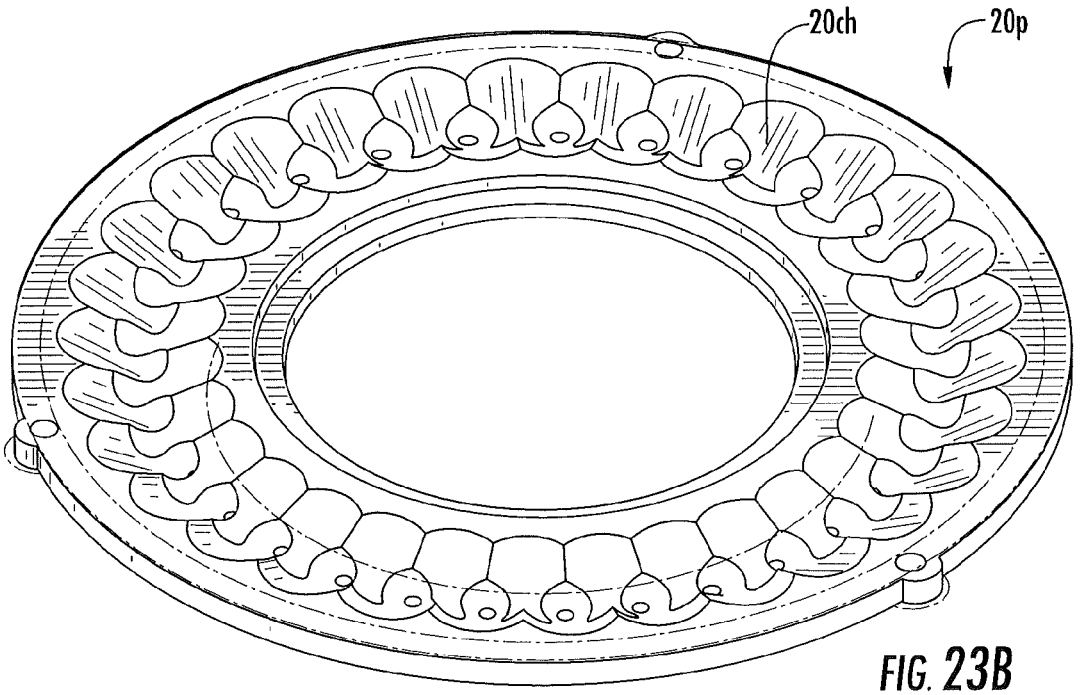
FIG. 23B is a top perspective view of the device shown in FIG. 23A.
Figure 24A:
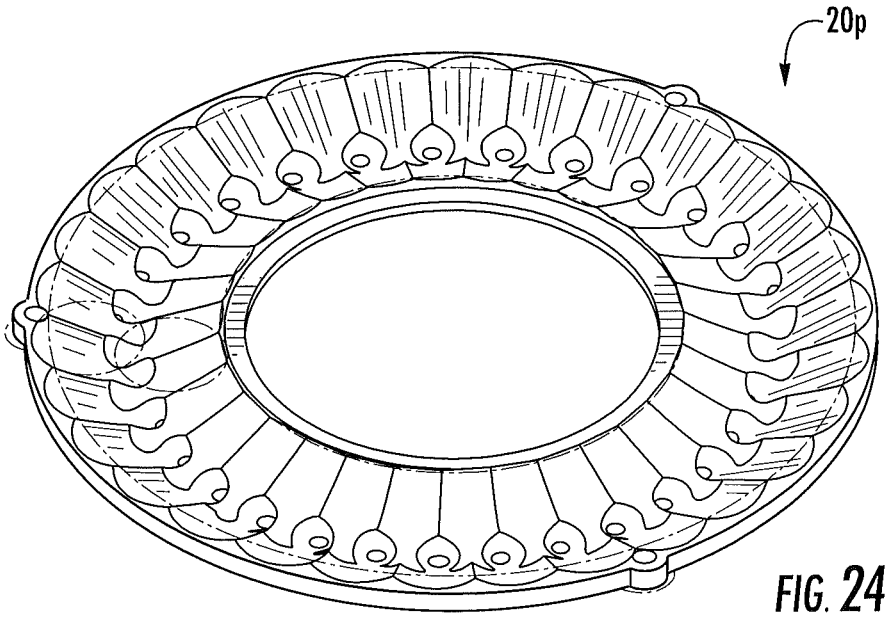
FIG. 24A is a top perspective view of a dosing head with alternating inward and outward sloping channels similar to that shown in FIG. 23A but with larger exit ports according to embodiments of the present invention.
Figure 24B:
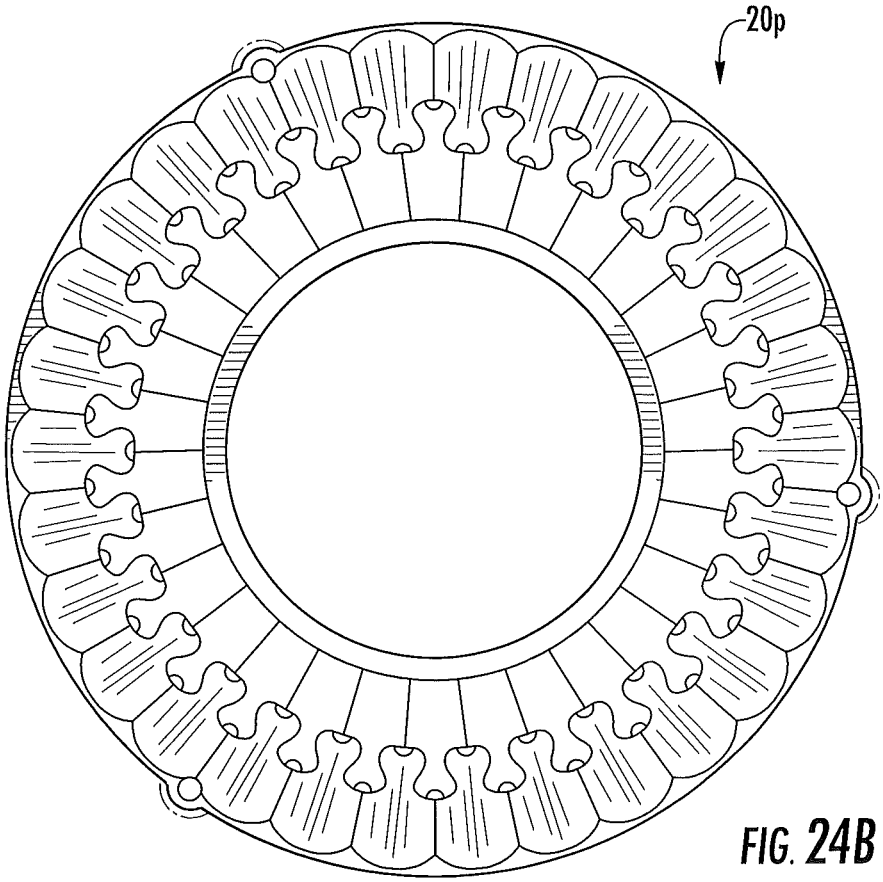
FIG. 24B is a top view of the device shown in FIG. 24A.
Figure 24C:
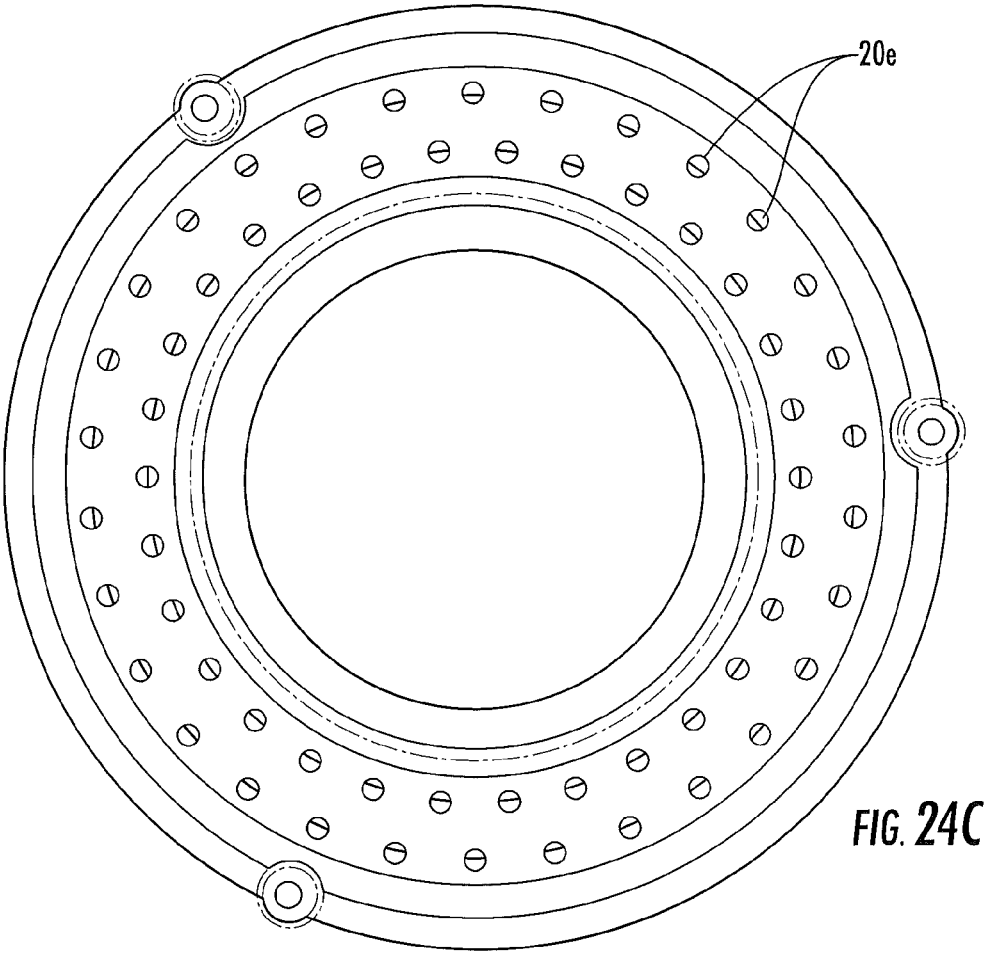
FIG. 24C is a bottom view of the device shown in FIG. 24A.
Figure 24D:
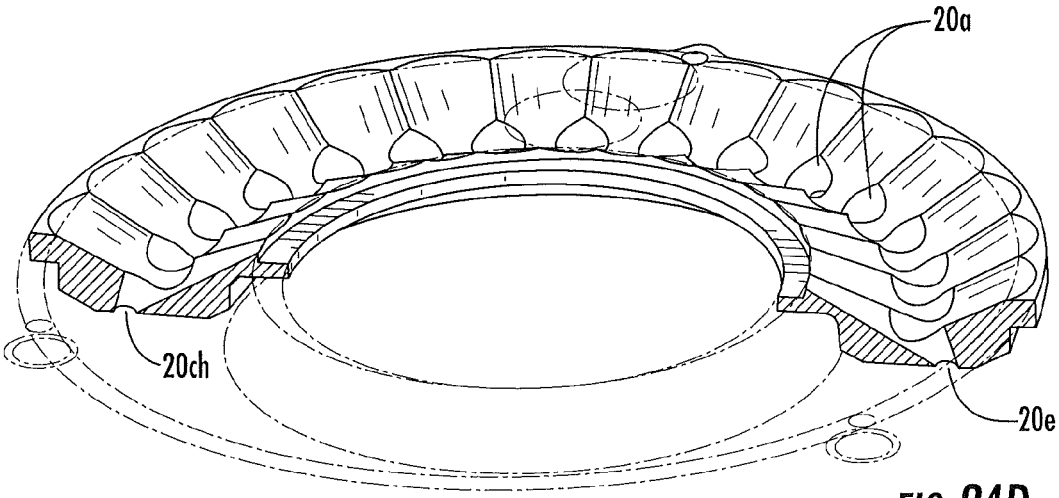
FIG. 24D is a cutaway view of the device shown in FIG. 24A.
Figure 24E:
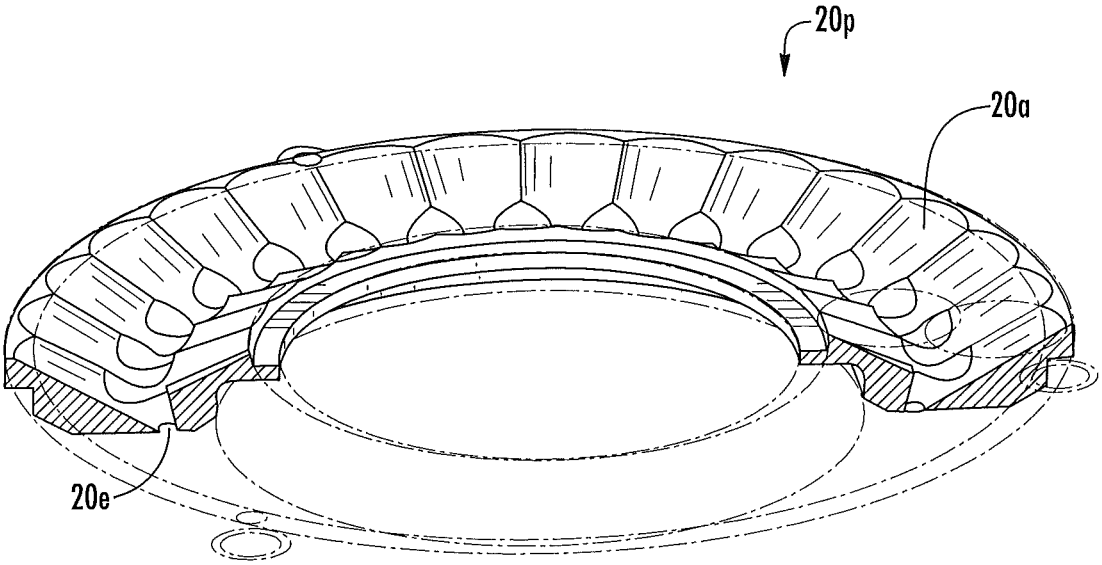
FIG. 24E is another cutaway view of the device shown in FIG. 24A.

FIGS. 21A-21D show about a 40 degree funnel angle with overlapping entry ports 20*a* and alternating inward and outward sloping channels 20*ch*. FIGS. 22A-22C show a 60 degree funnel angle with overlapping entry ports 20*a* and alternating inward and outward sloping channels 20*ch*. FIGS. 5D and 5E show a 60 degree channel with all of the channels 20*ch* angled inward (and with an oval top entry port 20*a* with the long sides of the oval circumferentially oriented about the plate 20*p*. FIGS. 23A-23B and 24A-24E show a 30 degree funnel (with overlapping entry ports 20*a* and alternating inward and outward sloping channels 20*ch*).

In some embodiments, the channels 20*ch* can have an offset geometry that can help prevent the undesired plugging or rat-holing of powder flow. That is, as shown in FIG. 9B, in some embodiments, the channels 20*ch* can have sidewalls with one portion 21*u* with a longitudinally extending centerline 21*c* which angles or slopes downward at a first defined angle "α1" that merges into a lower portion 21*l* with sidewalls 20*w* that are oriented at a second different angle "α2", such as a lower channel portion with a vertically extending centerline 21*v* at the exit port 20*e*. Typically, the first angle α1 is between about 30 degrees to about 75 degrees from horizontal, and more typically is between about 30 degrees to about 45 degrees, such as about 40 or 41 degrees from horizontal.

It is also noted that although shown as angling down in the right hand direction in several figures, the channels 20*ch* can slope the opposite way. Indeed, different channels in a dosing head or plate can be oriented to angle in the opposite directions, e.g., the channels 20*ch* associated with exit ports 20*e* on the outer row can angle down and outward while the channels associated with exit ports 20*e* on the inner row can angle down and inward (where two rows of concentric/circular channels are used) or vice versa. See, for example, FIGS. 21A, 22A, 23A, and 24A which illustrate alternating inward and outward sloping channels 20*ch* with 60 channels 20*ch*, 30 exit ports 20*e* on each of the inner and outer circular rows (and offset from each other).

The vibration signal 28*s* can be generated by any suitable vibratory source, including electrical means, mechanical means, electromagnetic means and/or electro-mechanical means. As shown, the vibration source 25 includes at least one actuator 25 in communication with the dosing head 20 and a vibration control circuit 28. It is contemplated that more than one actuator may be used for each set of dosing channels or for each plate 20*p* (the dosing plate is shown in various figures, e.g., FIGS. 5A, 8A-8C, 17A-17C).

The actuator(s) 25 can be configured to be substantially in-line with the dosing head 20 and one-directional. The actuator 25 can apply the flow signal (e.g., flow energy) in a substantially vertical (only) direction. As shown in FIGS. 1 and 5A, the actuator 25 can be mounted to a rod 29 that is attached to a center of the dosing head 20. The flow signal/energy 28*s* can be applied so that the displacement is substantially all vertical but typically so that there is limited physical vertical displacement during the dispensing step. The actuator 25 can be an in-line magnetostrictive actuator or any other suitable actuator or controllable vibrating member. For example, Model CU18 magnetostrictive actuator from Etrema Products, Ames, Iowa. The stimulation or vibration motion can have a defined displacement profile, such as a non-harmonic displacement profile. The stimulation/vibration flow signal 28*s* can be generated in-line with a vertical axis associated with the dosing head ("A") so as to apply the flow energy so that the dosing head with a vertical displacement that is less than about 25 microns. As noted above, the target dose container member 30 can be closely spaced apart from a lowermost surface of the dosing head 20, such as between about 20-100 microns, during filling.

In other embodiments, a piezoelectric material (e.g., crystal or ceramic) with an opening that aligns to the entry orifice 20*a* can be attached to each dosing channel. This can provide an individual actuator for each channel (not shown).

The vibration signal 28*s* is selected to dispense dry powder at a defined flow rate (with acceptable variation, typically +/−5-10%) for a particular channel geometry. As noted above, the channel geometry can be selected so that the flow is controllable, e.g., there is no free-flow of powder out or through the channels 20*ch* without the flow signal 28*s*. In operation, a continual vibration signal or signals can be applied to the dosing head (or individually to the channels 20*ch*), and a "burst" of energy can be applied as the flow signal 28*s* for a short duration to carry out the filling process. For example, a vibratory signal can be applied to the dosing head/powder bed to help avoid powder segregation. A high frequency can be modulated "on" and "off" as impulses for providing the vibratory flow signal. In other embodiments, no "background" vibration is used and the vibration can be applied only to generate the flow signal. The vibration signal 28*s* can include, for example, a saw tooth, square or sine wave associated with a waveform generator. The signal 28*s* can be configured to generate less than about an 80 micron vertical displacement of the head 20 and/or plate 20*p*. The frequency or frequencies of the flow signal 28*s* can be between about 100 Hz to about 5000 Hz, but other frequencies may be used. The vibration signal can be frequency modified, e.g., a frequency modulated sinusoidal signal. Powder-specific signals may be used. See, e.g., U.S. Pat. No. 6,985,798, the content of which is hereby incorporated by reference as if recited in full herein. The dosing head 20 can have integrated dosing channels 20*ch* or the dosing channels 20*ch* can be provided in a plate 20*p* (FIGS. 6, 7, 21 et seq.) or other member that is attached to a portion of the dosing head. The plate 20*p* can be releasably attached to a frame or sidewalls of the dosing head 20 under the dry powder of the powder bed 23. In other embodiments, one dosing head can hold a plurality of the plates in spaced apart arrangements (FIG. 12B) and/or can include a plurality of integrated spaced apart circular dosing channels to allow for filling a plurality of disks with a single dosing head 20 and powder bed 23.

Figure 6:
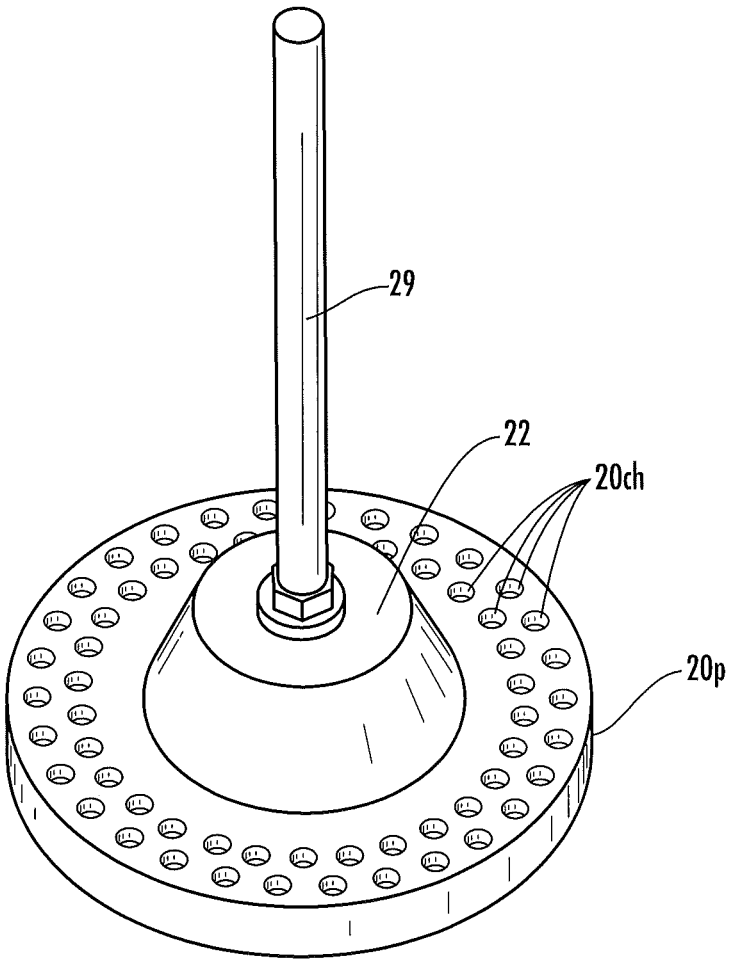
FIG. 6 is an enlarged side perspective view of a plate with dosing channels according to embodiments of the present invention.
Figure 7:
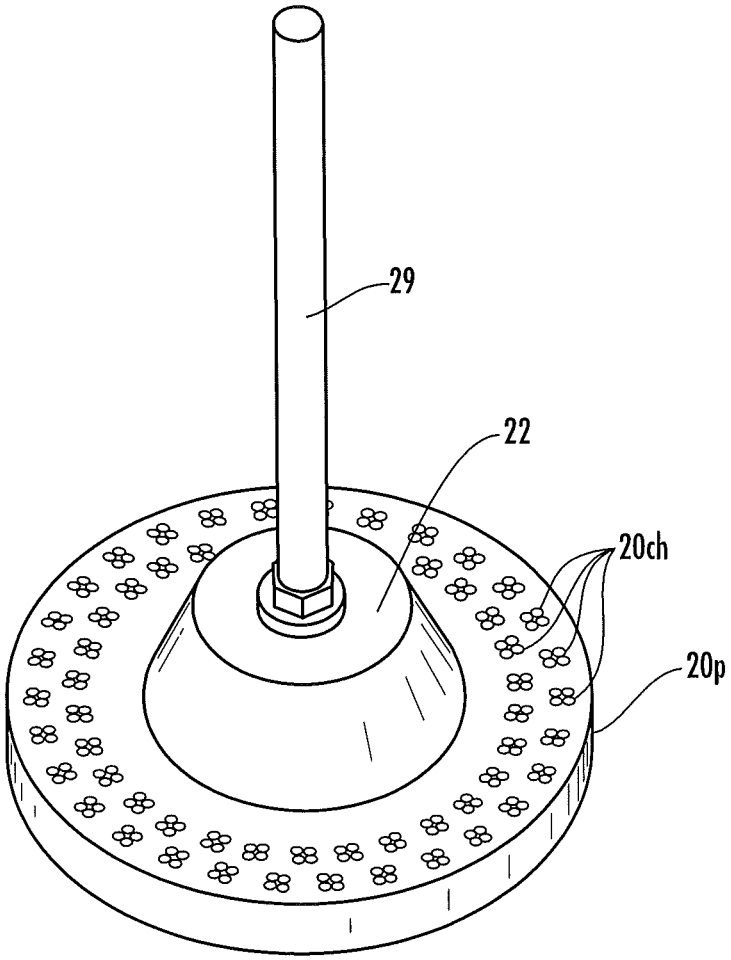
FIG. 7 is an enlarged side perspective view of another example of a plate with dosing channels according to embodiments of the present invention.
Figure 8A:
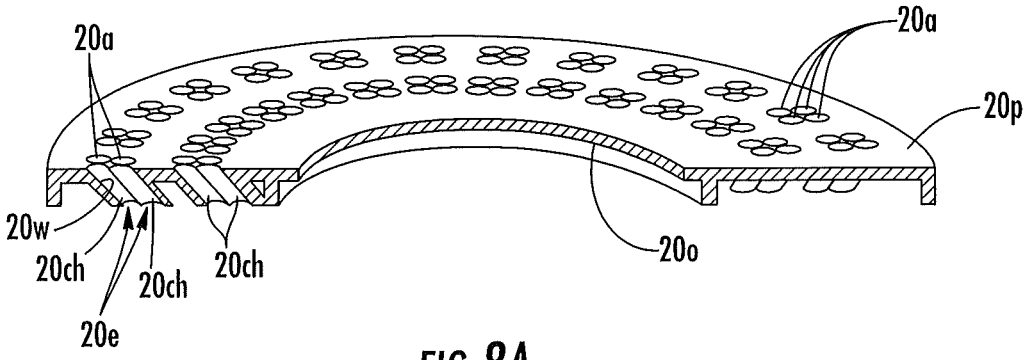
FIG. 8A is a side sectional view of the plate shown in FIG. 7 according to some embodiments of the present invention.
Figure 8B:
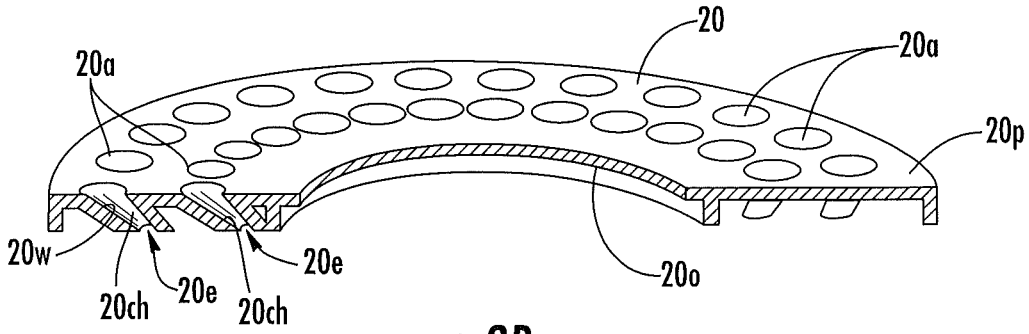
FIG. 8B is a side sectional view of the plate shown in FIG. 6 according to some embodiments of the present invention.
Figure 8C:
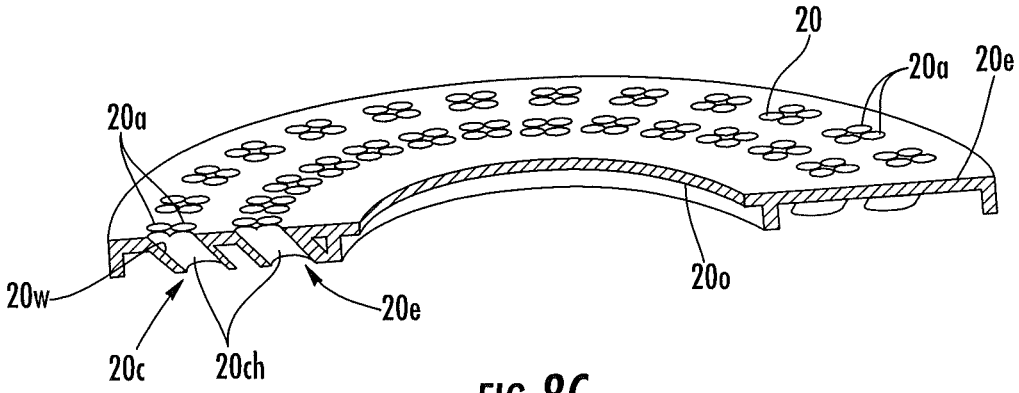
FIG. 8C is an alternate side sectional view of the plate shown in FIG. 7 according to yet other embodiments of the present invention.

In some embodiments, as shown in FIGS. 1, 3A-3D and 5A-5C, for example, the dose container member 30 is a dose disk with at least one row of dose containers 30*c* that are circumferentially spaced apart. Thus, the dosing head 20 can include a corresponding arrangement of dosing channels 20*ch*. In some embodiments, such as shown in FIGS. 6 and 8B, there is one entry orifice 20*a* and associated dosing channel 20*ch* for each dose container 30*c*. In other embodiments, such as shown in FIGS. 7, and 8A, for each dose container 30*c*, the dosing head 20 has a plurality of closely spaced entry orifices 20*a* and corresponding dosing channels 20*ch*. In other embodiments, as shown in FIG. 8C, there can be a plurality of orifices 20*a* that open into a common dosing channel 20*ch* for a respective dose container 30*c*.

Figure 3A:
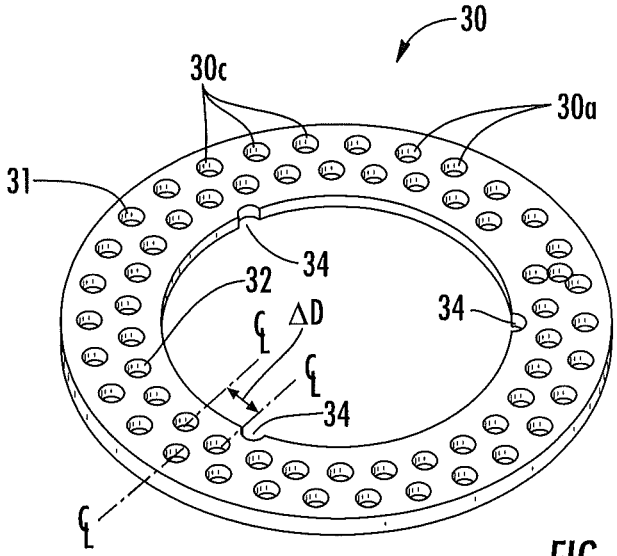
FIG. 3A is a top perspective view of a dose container disk according to some embodiments of the present invention.

FIG. 3A illustrates a dose container assembly 20 with a dose ring or disk 30 having a plurality of dose containers 30*c*. The dose containers 30*c* can have a volume (prior to filling and sealing) that is less than about 24 $mm^3$, typically between 5-15 $mm^3$. The powder bulk density can be about 1 $g/cm^3$ while the power nominal density when filled (for reference) can be about 0.5 $g/cm^3$. The maximum compression of a drug after filling and sealing in the dose container 30*c* can be less than about 5%, typically less than about 2%.

In some embodiments, the dosing channel exit ports 20*e* (e.g., orifice) can have a cross-sectional length or width (e.g., diameter) that is about 3.2 mm or less.

Figure 3B:
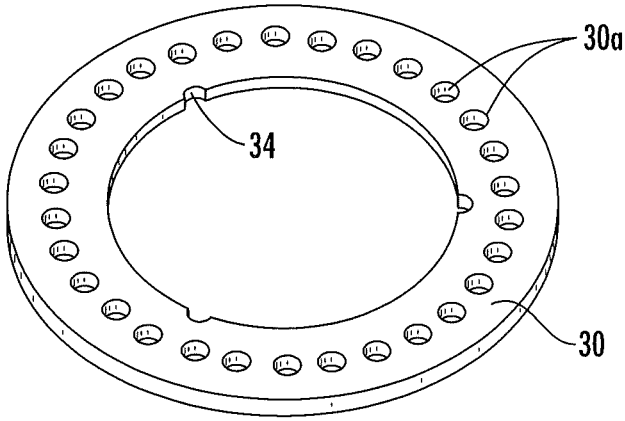
FIG. 3B is a top perspective view of a dose container disk according to some other embodiments of the present invention.
Figure 3C:
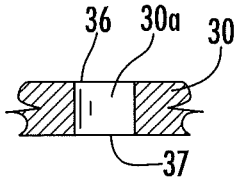
FIG. 3C is a partial section view of an exemplary disk container configuration for dose containers associated with the dose container disk of FIG. 3A or 3B according to embodiments of the present invention.
Figure 3D:
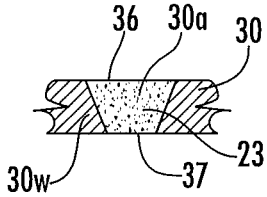
FIG. 3D is a partial section view of another exemplary dose container configuration for dose containers associated with the dose container disk of FIG. 3A or 3B according to embodiments of the present invention.

As shown in FIGS. 3A and 3B, in some embodiments, the dose ring or disk 30 can include a plurality of circumferentially spaced apart through apertures 30*a* that form a portion of the dose containers 30*c*. As shown in FIGS. 3C and 3D, the dose containers 30*c* can be defined by the dose container apertures 30*a* and upper and lower sealants 36, 37 (after filling with the dry powder 23 therein). FIG. 3A illustrates that the dose container disk 30 can include 60 dose containers 30*c* while FIG. 3B illustrates that the dose container disk 30 can include 30 dose containers 30*c*. Greater or lesser numbers of dose containers may be used. As noted above, the dosing head 20 can include a like number of or at least the same number of dosing channels 20*ch* (or more if more than one dosing channel 20*ch* is used to fill a corresponding container 30*c* such as shown in FIG. 7). The sealant layers 36, 37 can have the same or different material(s) and may include foil, polymer(s) and/or elastomer(s), or other suitable material or combinations of materials, including laminates. Typically, the sealant layers 36, 37 are thin flexible sealant layers comprising foil.

In other embodiments, the bottom of the dose container 30*c* may be provided by a closed floor of the substrate rather than a sealant layer. In yet other embodiments, the dose disk 30 can have a blister configuration which is filled by the dose head 20.

FIGS. 3A and 3B also illustrate that the dose container disk 30 can include at least one indexing notch 34, shown as a plurality of circumferentially spaced apart indexing notches 34.

As shown in FIGS. 5A-5E, the system 10 can include a mounting member 22 that has a threaded member 22*t* with a collar 22*c* that holds the stem 29 to the dosing head 20 to releasably engage the dosing head 20 and align the dose container 30 with the dosing head 20 using one or more of the notches 34. For example, the holder 40 can include a spring-loaded, radially outwardly extending finger or tab that releasably engages one or more of the notches 34 to position the dose containers 30*c* so that they are aligned with channels 20*ch*. FIG. 12C illustrates an alternate holder 40 configuration with a center post 44 with a channel 41 and upstanding outer indexing tabs 40*p*. Other holders and alignment means may be used.

As shown in FIGS. 3A and 3B, the dose containers 30*c* may be arranged so that they are circumferentially spaced apart in one or more rows. As shown in FIG. 3A, the dose containers 30*c* are arranged in staggered concentric rows, a front row 31 at a first radius from a center of the disk and a back row 32 at a second different radius. Thus, the dosing channels 20*ch* and the corresponding dose containers 30*c* can be arranged so that centerlines of the dosing channels 20*ch* and dose containers 30*c* of the back row are circumferentially offset from the centerlines of the dosing channels and dose containers 30*c* in the front row by a distance. As shown in FIG. 3A, the dose containers 30*c* on each respective row are spaced apart a distance "D" and the offset of the centerlines of those on the back row to those on the front row is "D/2". The dosing channels 20*ch* can have a corresponding layout or arrangement. The dose container disk 30 can be a molded polymer, copolymer or blends and derivatives thereof, or may comprise metal, or combinations thereof, or other materials that are capable of providing sufficient moisture resistance. The dosing head can comprise stainless steel or other suitable non-reactive material or materials that can be cleaned to meet regulatory cleanliness standards.

The dose container disk 30 can have an outer diameter of between about 50-100 mm, typically about 65 mm and a thickness of between about 2-5 mm, typically about 3 mm. The disk 30 can comprise a cyclic olefin (COC) copolymer. The apertures 30*a* can have a diameter of between about 2-5 mm, typically about 3 mm and the sidewalls 30*w* of the dose containers 30*c* may have an angle or draft of about 1-3 degrees per side, typically about 1.5 degrees, as shown in FIG. 3D, to facilitate removal from a mold (where a molding process is used to form the disk 30). The dose container 30 is configured to be able to protect the powder from moisture ingress, while providing a desired number of doses in a compact overall inhaler size. The individual dose container apertures 30*a* are spaced apart from each other to allow sufficient seal area and material thickness for moisture protection of the powder.

Figure 4:
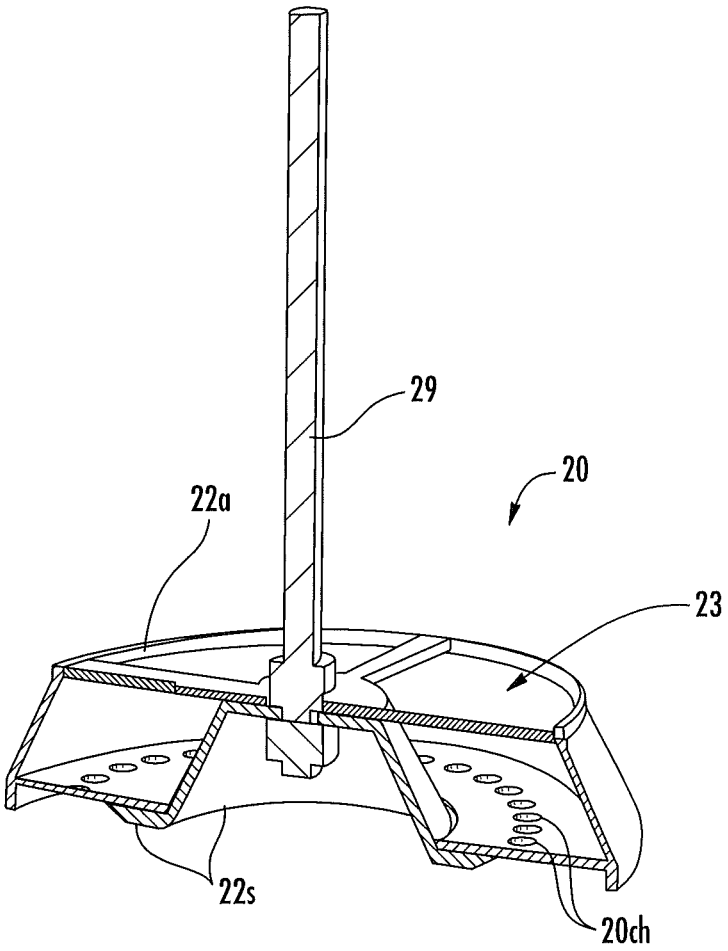
FIG. 4 is a sectional view taken along line 4-4 of FIG. 1.

FIG. 4 illustrates an exemplary configuration of a dosing head 20 attached to the rod 29 and having a bracket 22 with a support 22*s* that engages a lower portion of the bed 23 in a manner that does not occlude any of the flow channels. The bracket 22 can include outwardly extending arms 22*a* that attach to an upper portion of the powder bed 23. The channels

20*ch* can be integral to the bed 23 or may be provided in a plate, disk or other component that attaches to the dosing head.

Figure 5C:
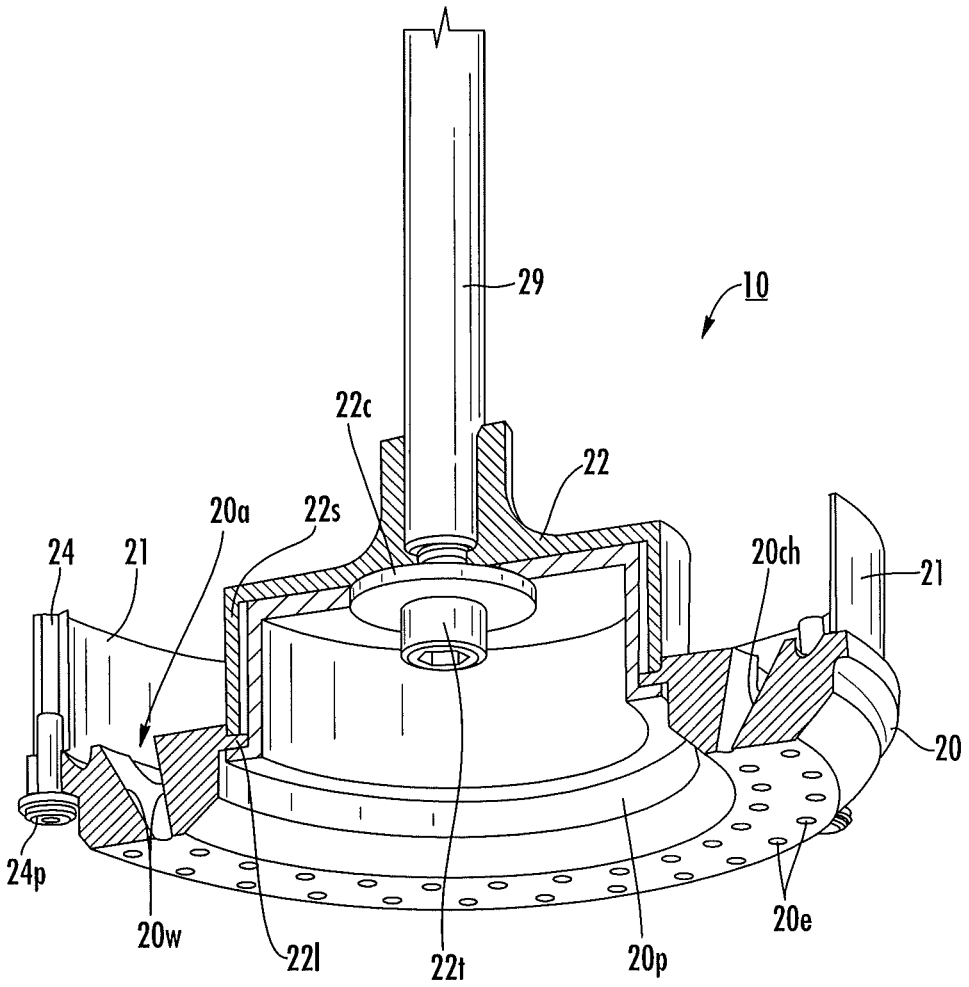
FIG. 5C is a partial cutaway side perspective view the dosing head shown in FIG. 5A according to embodiments of the present invention.
Figure 5D:
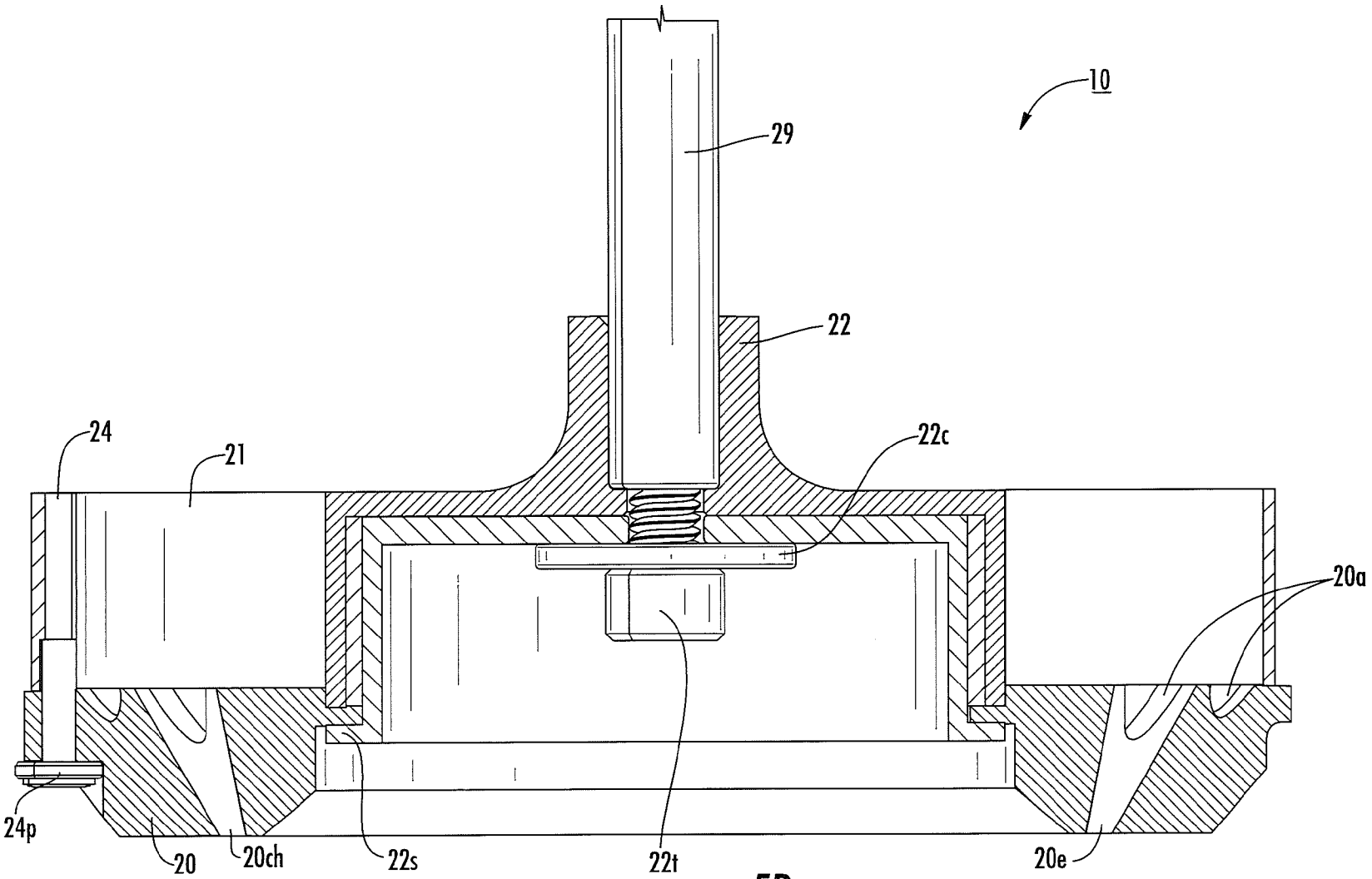
FIG. 5D is a side partial sectional view of the dosing head shown in FIG. 5C.
Figure 5E:
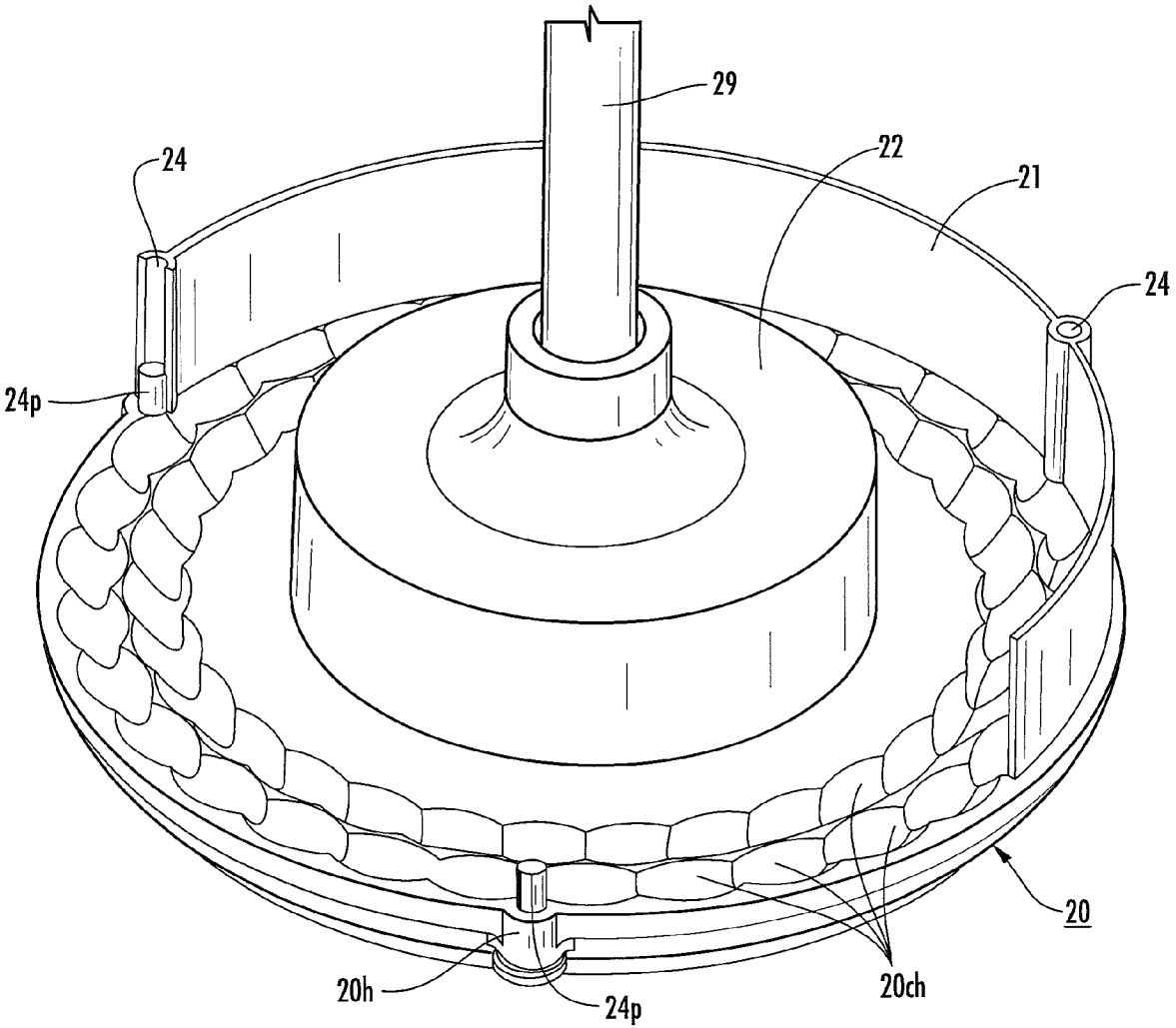

FIGS. 5A-5E illustrates the dosing head 20 with a lower plate 20*p* defining the channels 20*ch*. As shown in FIGS. 5B and 5C, for example, the plate can include an inwardly extending ledge or lip 22*l*. The plate 20*p* can reside on the ledge 22*l* and can be releasably attached to the head 20 and/or bed 23.

Referring to FIG. 5A, the filling system 10 can include a dose container holder 40 that registers the dose container apertures 30*a* to the filling channel exit ports 20*e* using the indexing notches 34 on the container 30 (FIGS. 3A/3B). However, the system can use other components, geometry or indexing configurations to carry out the registration. For example, in other embodiments, the dosing head 20 can be configured to rotate to align with the dose containers 30*a* using optical or proximity sensors, lasers or other automated position controlled devices.

As shown in FIGS. 5C-5E, 8A-8C, and 21-24, the dosing head plate 20*p* can have an open center space 20*o* that receives the support bracket or member 22 which is substantially in-line with the rod 29. In some embodiments, the dosing head 20, plate 20*p* and/or support frame 22 can be configured so that the vibration transferred by the rod 29 is substantially evenly distributed from the center to a location that is at least co-extensive with the outer row of dosing channels.

Figure 25A:
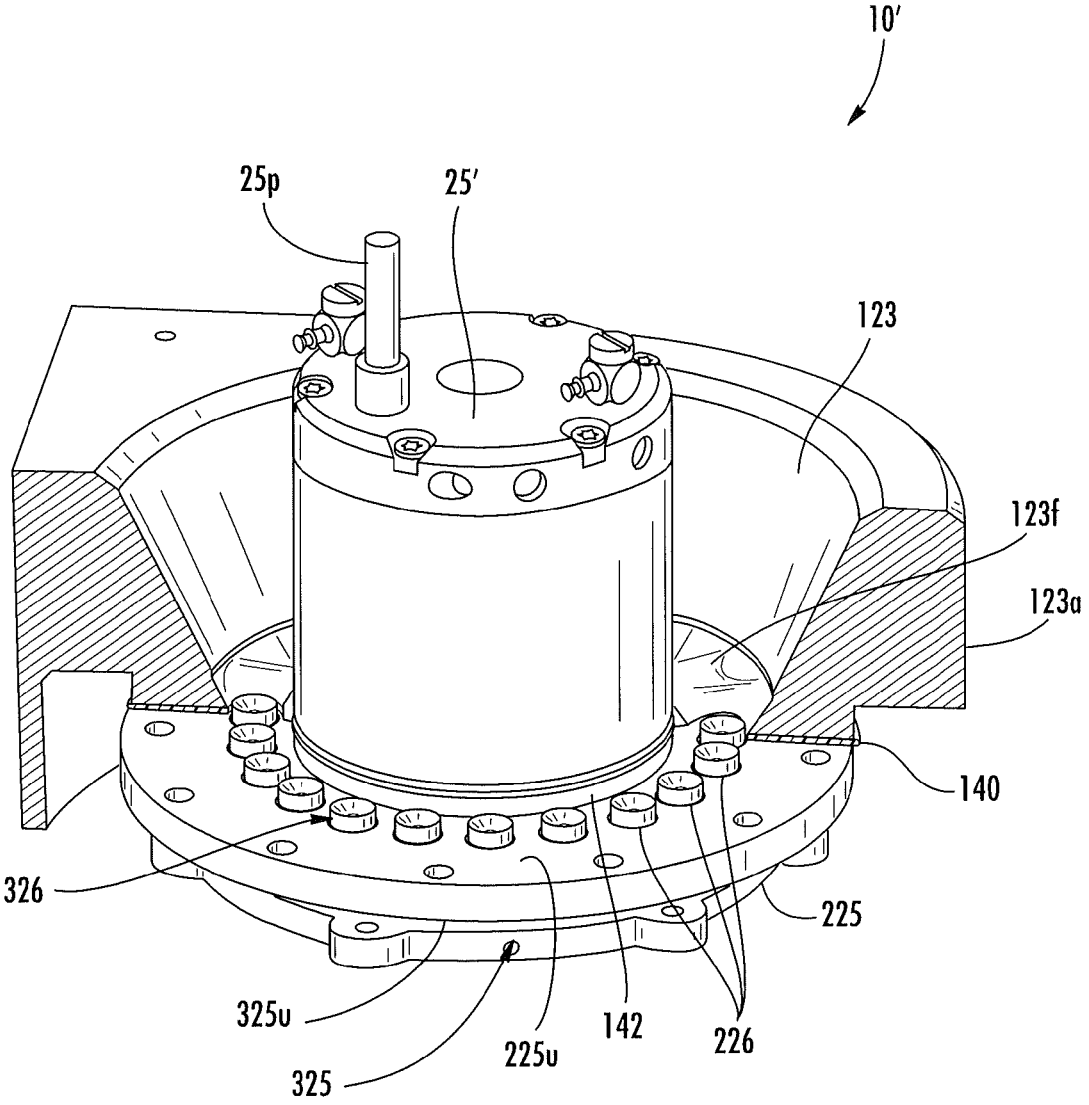
FIG. 25A is a partial cutaway top view of a dose filling system according to embodiments of the present invention.
Figure 25B:
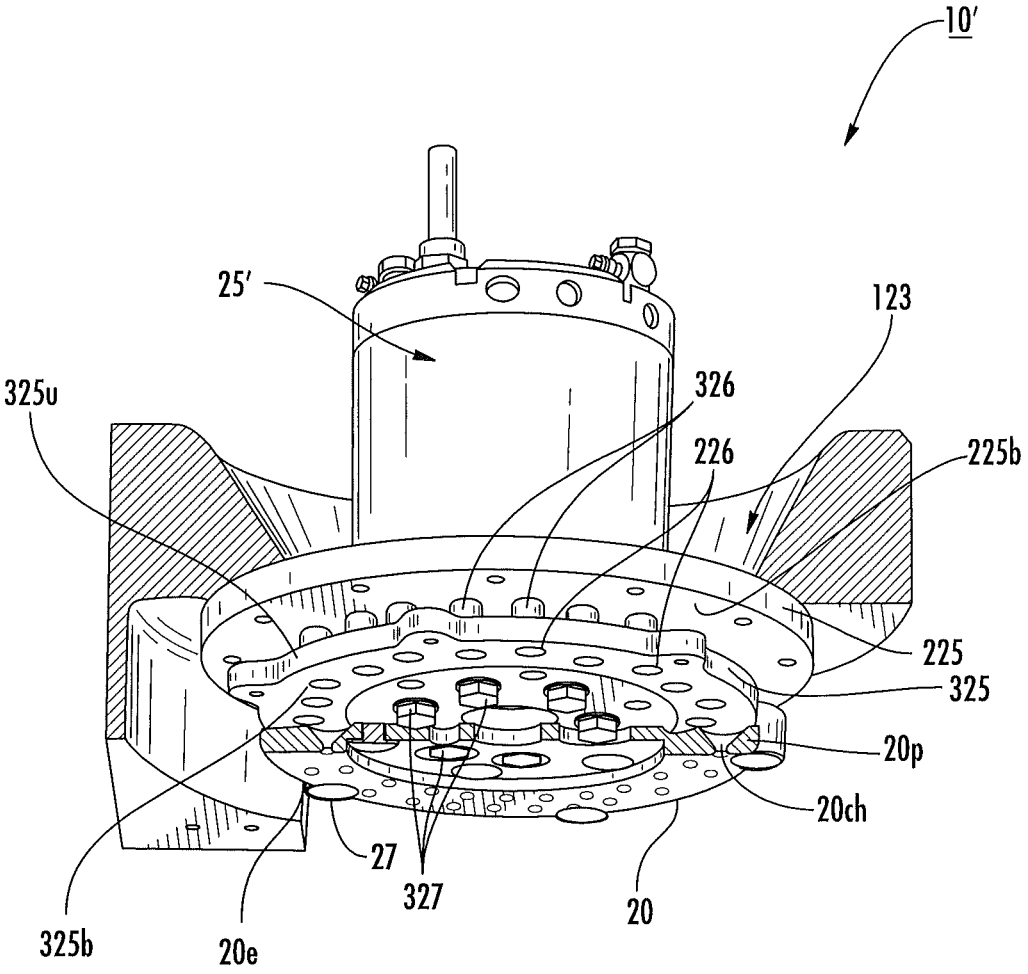
FIG. 25B is a partial cutaway bottom view of the dose filling system shown in FIG. 25A.
Figure 26:
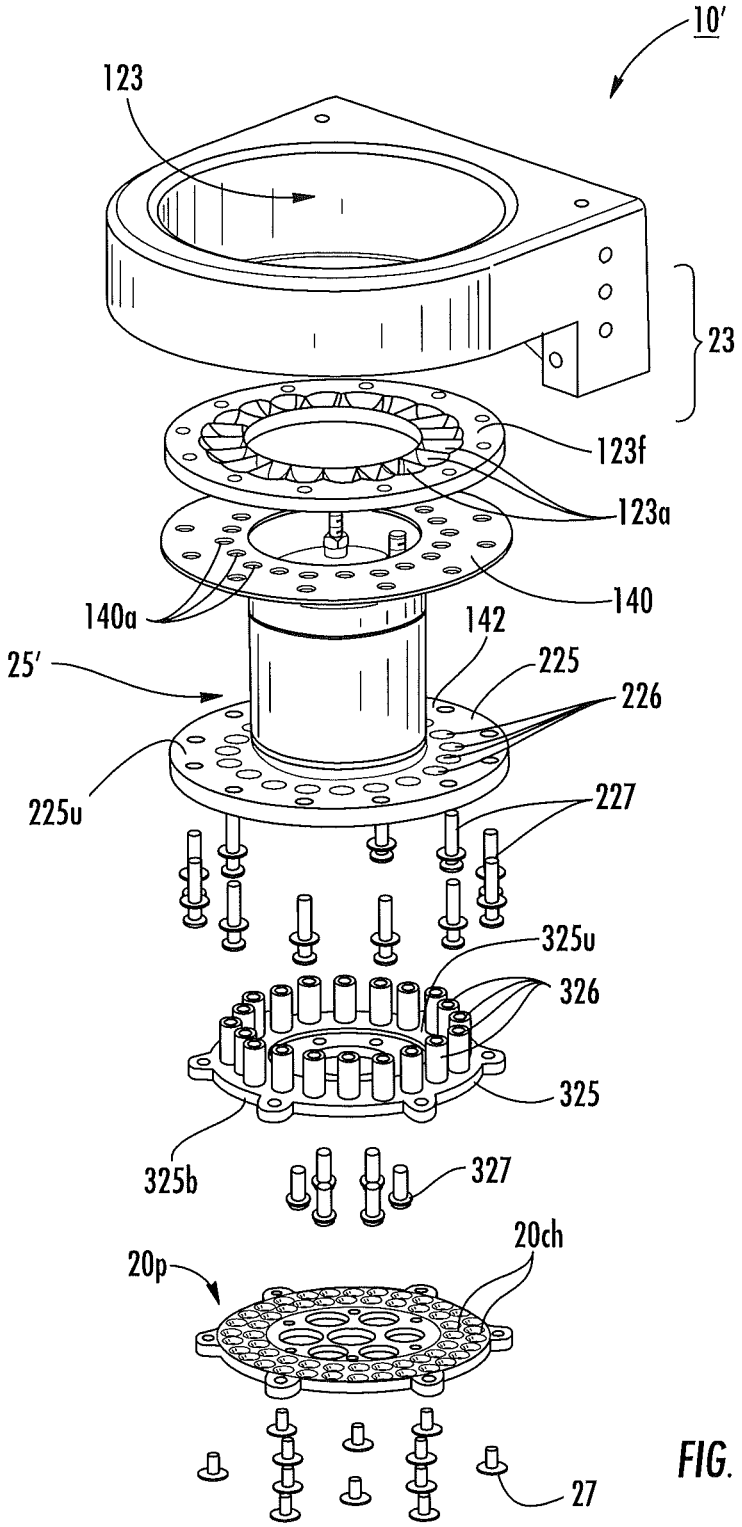
FIG. 26 is an exploded view of the system shown in FIG. 25A.

FIGS. 25A, 25B and 26 illustrate an alternate mounting of the actuator 25' and dosing head 20 (which typically includes a dosing plate 20*p*, also referred to as an "orifice plate"). In this embodiment, the actuator 25' is positioned closely spaced to the dosing head 20 so as to not require an overhead actuator and connecting rod to improve coupling of the vibration to the orifice plate/dosing head 20*p*/20. As before, although the dosing head 20 is shown comprising a (releasable) dosing plate 20*p*, the dosing head may be an integral body device with the channels 20*ch*. Where an orifice plate 20*p* is used, the plate 20*p* can be provided in two or more matable pieces (not shown) and may include inner or outer sidewalls that form part or all of the powder bed (also not shown). In this embodiment, the (lowermost) orifice plate 20*p* is mounted to a tube plate 325 with an array of tubes 326 that penetrate through aligned apertures 123*a* in the floor 123*f* of a (small) powder bed 23. The combined orifice plate 20*p* and tube plate 325 can attach directly to an integrated central actuator 25' that vibrates them. The vibrating tubes 326 help flow powder to the orifice plate 20*p* while the orifices 20*ch* still provide on/off flow control for controlled dispensing.

FIGS. 25A, 25B and 26 illustrate that the dry powder bed 23 can be provided by a rigid powder hopper 123 having a rigid bottom floor 123*f*. The floor 123*f* can include apertures 123*a* (FIG. 26) that receive the array of upwardly extending tubes 326. The floor apertures 123*a* can have geometries that funnel powder downward.

The actuator 25' can include a radially extending planar flange 225 with a plurality of circumferentially spaced apart apertures 226. The vibrating tubes 326 extend through these apertures 226 to communicate with the power bed 23. The tubes 326 are free to vibrate up and down in response to the vibration input from the actuator 25' during operation as there is a non-contact clearance around each vibrating tube 326, actuator flange 225 and hopper bottom 123*f*. As before, the actuator 25' can be configured to be substantially in-line with the dosing head 20 and one-directional. The actuator 25' can apply the flow signal (e.g., flow energy) in a substantially vertical (only) direction. The flow signal/energy 28*s* can be applied so that the displacement is substantially all vertical but typically so that there is limited physical vertical displacement during the dispensing step. The actuator 25' can be an in-line magnetostrictive actuator or any other suitable actuator or controllable vibrating member. In some embodiments, the actuator 25' includes a plurality of, typically three, spaced-apart precision linear actuators that vibrate at least 3 points on a plane concurrently. For example, Model PI P/N S-9000002 actuator from PI (Physik Instrumente) L.P., Auburn, Mass. The stimulation or vibration motion can have a defined displacement profile, such as a non-harmonic displacement profile. The stimulation/vibration flow signal 28*s* can be generated in-line with a vertical axis associated with the dosing head ("A") so as to apply the flow energy so that the dosing head with a vertical displacement that is less than about 25 microns. As noted above, the target dose container member 30 can be closely spaced apart from a lowermost surface of the dosing head 20, such as between about 20-100 microns, during filling.

The actuator 25' can be configured to have a pre-load tensioning/compression to achieve a desired bipolar action in a dynamic mode. Actuator power wiring 25*p* can be provided via the top of the cylindrical body 25' as shown in FIG. 25A (but side or even bottom wiring (or wireless) may also be used).

As shown in FIG. 26, an elastomeric gasket 140 can reside under the floor 123*f* and above the flange of the actuator 25'. The gasket 140 can include an array of apertures 140*a* that align with the actuator flange apertures 226. The gasket 140 is not a compression spring. An O-ring 142 can also be placed against the outer wall of the actuator cylinder and the hopper floor 123*f* to form a seal.

As shown in FIGS. 25A, 25B and 26, the tube plate 325 has a planar upper surface 325*u* that holds the array of upwardly extending tubes 326 and this surface can be positioned to abut the flange actuator lower surface 225*b*. The tube plate 325 can also have a planar lower surface 325*b* that can be positioned to abut the top of the orifice plate 20*p*. The tubes 326 can be bonded, brazed, ultrasonically or metallurgically welded to the plate 325 or may be molded as a single-piece body or otherwise suitably formed. FIG. 25B shows that the tube plate 325 can be aligned with flange apertures and the tubes 326 slidably advanced to attach the tube plate 325 to the actuator flange 225 (the gap space shown between the actuator flange lower surface 225*b* and the upper surface of the tube plate 325*u* is not the typical operative position). It is also noted that, in lieu of flange apertures, slots or other passages or flange shapes may be used to allow the tubes 326 to extend above the flange to communicate with the hopper bed 23.

Bolts 27, 227, 327 can be used to releasably attach the tube plate 325, the actuator flange 225, the orifice plate 20 and/or the floor 123*f* together. However, in other embodiments, two or more of the components may be bonded, brazed, welded or otherwise be integrally attached together. It is contemplated that the assembly configuration used should be allow the tubes 326 to be free moving so as to not disrupt the vibration of the orifice plate/dosing head 20*p*, 20 and allow for uniformity of vibration over the ring of orifices in the dosing head/plate.

In some embodiments particularly suited for filling a dose disk with 60 dose containers in two concentric rows with the dose containers in each row having circumferentially offset centers, the tubular plate 325 can include 20 equally circumferentially spaced apart tubes 326 positioned at a common defined radial distance. The underlying orifice plate 20*p* can include 60 channels 20*ch* that align with 60 dose container apertures 30*c* for one dose disk 30 as described above (FIG.

Figure 27:
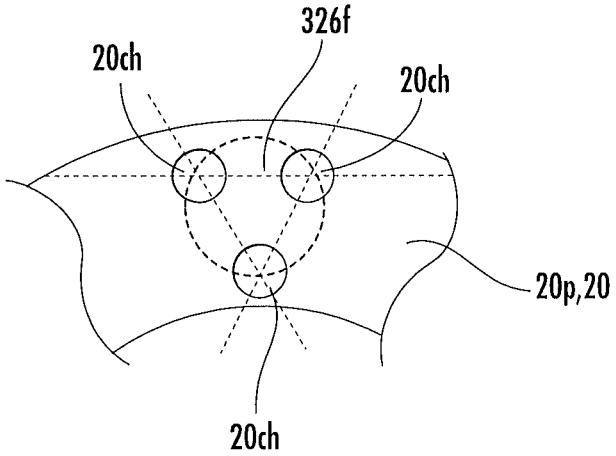
FIG. 27 is a schematic illustration of an example filling tube to orifice channel alignment according to some particular embodiments of the present invention.

1). As shown in FIG. 27, each tube 326 can define a feed path 326*f* that can be equally spaced apart over a set of three closely spaced channels 20*ch* of the orifice plate 20*p* to feed dry powder concurrently to each of those three channels 20*ch*. The center of a respective feed tube 326 can reside above a triangle drawn by lines connecting the centers of each of the respective three channels 20*ch*.

In other embodiments, a single tube 326 can feed a single orifice plate channel 20*ch* or more than one tube 326 can feed a respective one channel 20*ch*. As noted above, the dose filling system 10' may be configured to concurrently fill all dose containers 30*c* on a disk 30 or other configuration and the disk can include different numbers of dose containers 30*c*, such as 30 dose containers. The orifice dispensing channels 20*ch* can feed one or more underlying dose containers 30*c* or more than one channel 20*ch* can be used to fill an underlying dose container 30*c* as discussed above.

Figure 10:
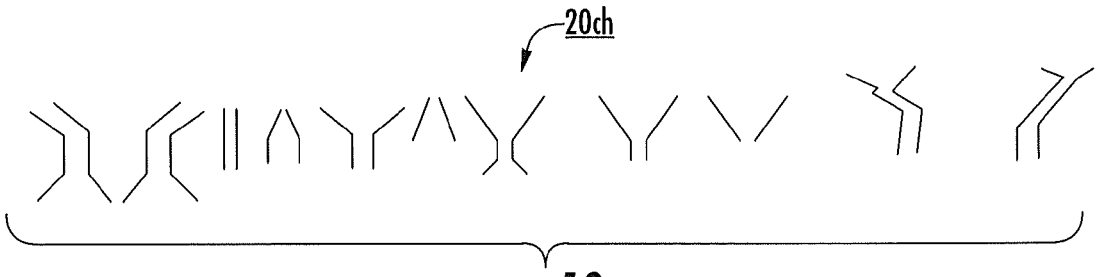
FIG. 10 is a schematic sectional view of different exemplary channel geometries according to embodiments of the present invention.

FIG. 10 illustrates different exemplary geometries for flow channels 20*ch*. The geometries include "straight" vertical flow channel geometries (with a suitable, very small size, orifice to avoid "free-flow" of the dry powder), funnel, inverse funnel, funnel to straight, funnel to angled and multiple angle changes over the length of the flow channel.

FIGS. 21-24 show examples of channels 20*ch* with different geometries. To be clear, although the channels 20*ch* are shown with respect to a dosing plate 20*p* with respect to different figures including FIGS. 21-24, 5A-5E, and 25A-25B, the channel geometries are not required to be implemented using a plate 20*p* but instead can be included into other structures, members or components, including an integral dosing head. The plate 20*p*, where used, may, in some embodiments, have a diameter or cross-sectional length of about 70 mm and may include a lip 22*l* (FIG. 5C). However, other shape and size plates may be used.

FIGS. 21A-21D show about a 40 degree funnel angle with overlapping entry ports 20*a* and alternating inward and outward sloping channels 20*ch*. FIGS. 22A-22C show a 60 degree funnel angle with overlapping entry ports 20*a* and alternating inward and outward sloping channels 20*ch*. FIGS. 5D and 5E show a 60 degree channel with all of the channels 20*ch* angled inward (and with an oval top entry port 20*a* with the long sides of the oval circumferentially oriented about the plate 20*p*. FIGS. 23A-23B and 24A-24E show a 30 degree funnel (with overlapping entry ports 20*a* and alternating inward and outward sloping channels 20*ch*). These figures also illustrate that the channels 20*ch* can define miniature hoppers which may help uniformly distribute powder 23 from the powder bed 23*b* into the channels 20*ch* and into the target receiving containers 30*a*.

FIGS. 21-24 also illustrate alternating inward and outward sloping channels 20*ch* with the upper portion of the channels having geometries configured to define overlapping entry ports 20*a* for at least two exit ports 20*e*, the upper portions of the channels 20*ch* a distance under the entry ports 20*a* merge into two respective exit ports 20*e* on front and back rows. The "crisscross" of downwardly sloping and narrowing funnels creates a shared upper collector bed that merges into lower isolated channel segments a distance down below the open top ports 20*a* toward (or even below) the middle portion. That is, the overlapping entry funnel shapes (shown as having semicircular outer perimeters) bifurcate into separate sloping lower channels 20*ch* at a location between about 30-80% of the channel length, typically between about 40-60% of the overall channel length (associated with the plate thickness) to angle in or out to feed adjacent pairs of inner and outer exit ports 20*e*. This creates a "mid-stage" powder bed that with vibration can provide a desired flow control and uniform powder distribution.

As shown in FIGS. 22A-C, the channels 20*ch* have geometries and exit port sizes configured so as to have minimal or no direct powder path from the top 20*a* to the exit port 20*e*. That is, when looking down from the top as shown in FIG. 22A, the exit port 20*p* is mostly, if not substantially entirely occluded from view. The exit port/orifice size can vary, but is typically less than about 1.8 mm, and more typically between about 1.2 mm-1.6 mm, for the limited or no "light" view path configuration.

Figure 11:
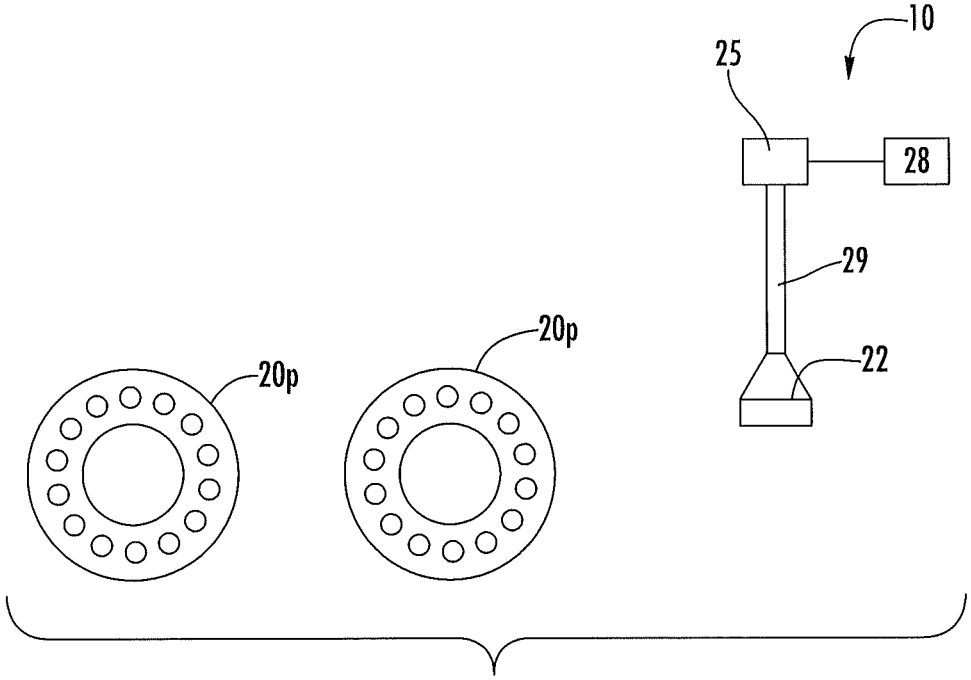
FIG. 11 is a schematic illustration of a filling system with interchangeable dosing heads or portions thereof (e.g., plates) with different channel geometries according to embodiments of the present invention.

FIG. 11 illustrates that the filling system 10 can be configured to accept interchangeable dosing plates 20*p* with different configurations of dosing channels 20*ch*. The control circuit 28 can be configured with a controller that has a library of "recipes" for selecting the corresponding operational parameters for generating the desired dose amounts of different dry powder formulations using the different dosing plates 20*p*. The dosing plates 20*p* can have an RFID or other electronic or optically readable data that identifies the plate type automatically.

Figure 12A:
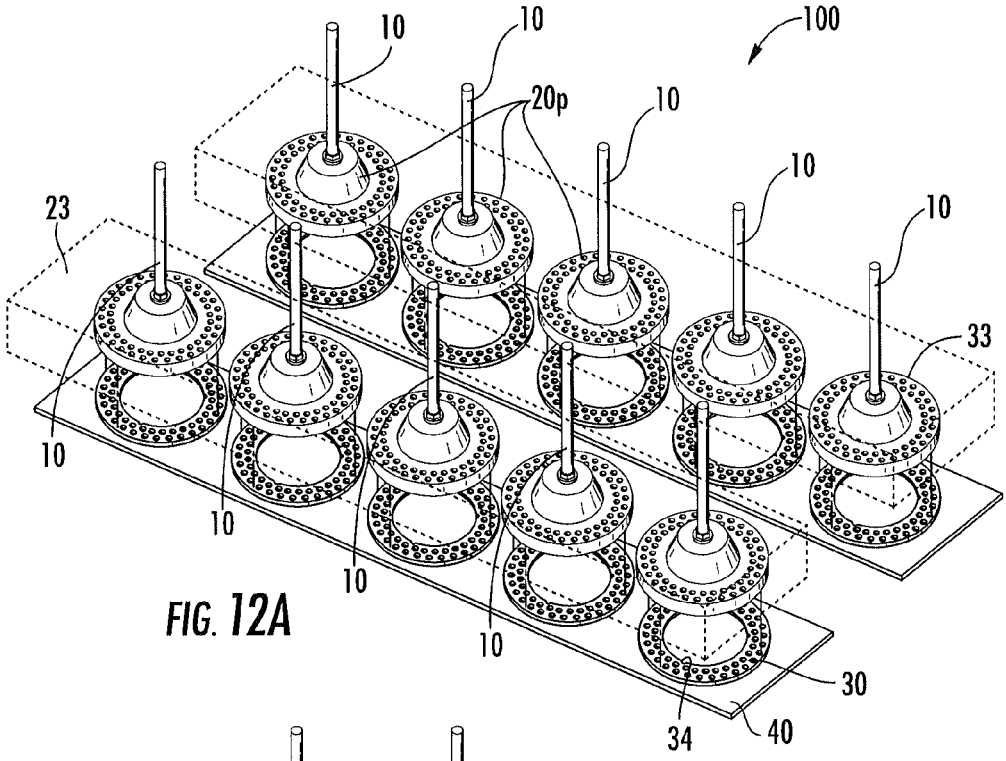
FIGS. 12A and 12B are schematic illustrations of exemplary dose filling systems with multiple filling stations according to embodiments of the present invention.
Figure 12B:
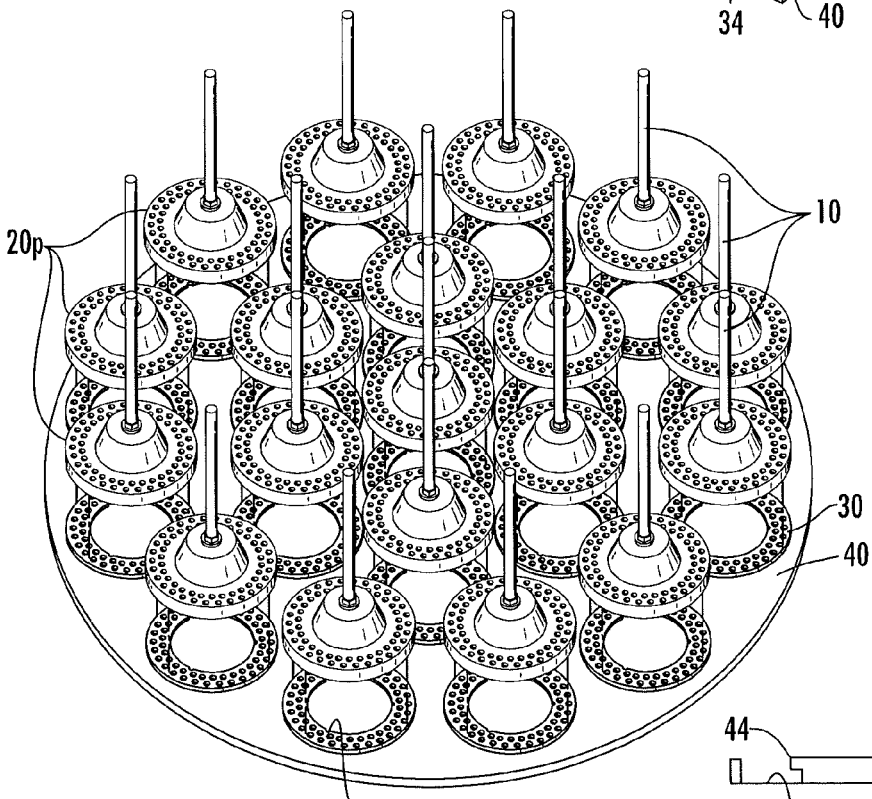
Figure 12C:
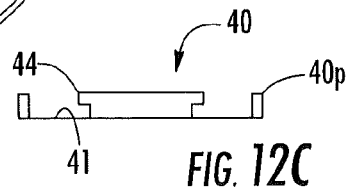
FIG. 12C is an enlarged section view of an exemplary holder for aligning a dose container member with a dosing head and/or dosing channels according to embodiments of the present invention.

FIGS. 12A and 12B illustrate examples of a filling system 100 with multiple sub-systems 10. The sub-systems 10 can be in a row as shown in FIG. 12A with the underlying dose container support members 30 provided in-line on a conveyor or other moving floor. A proximity sensor can be used to indicate when the dose containers 30*c* are in alignment with respective dosing channels 20*ch* and the vibratory flow signal 28*s* can be applied to fill the dose containers 30*c*. Each sub-system 10 can include its own powder bed 23 or, as shown, one line of the sub-systems includes a shared powder bed 23 and the other line includes another powder bed 23. Other dose bed arrangements can be used, such as two dosing heads in one line sharing one bed, four dosing heads can share a single bed 23 (two from each line or four from one line) and the like.

FIG. 12B shows that the sub-systems 10 can be closely spaced apart to overlie a circular holder with the containers 30. The system 100 can include a single powder bed or multiple powder beds (not shown). The holder 40 can be mounted to a carousel that rotates to present different holders 40 with collections of empty members 30 to the dosing station for filling. A proximity sensor can be used to indicate when the dose containers 30*c* are in alignment with respective dosing channels 20*ch* and the vibratory flow signal 28*s* can be applied to fill the dose containers 30*c*.

The holder 40 can be configured to hold a plurality of dose container members 30 in alignment with each other and with the dose containers 30*c* in position for alignment with the corresponding dose channels 20*ch*. As shown in FIG. 12C, the floor of each holder 40*f* can include a receiving channel 41 that matably engages the disk 30. The holder 40 can also include tabs 40*p* that engage the alignments slots 34 for circumferential alignment.

Figure 13:
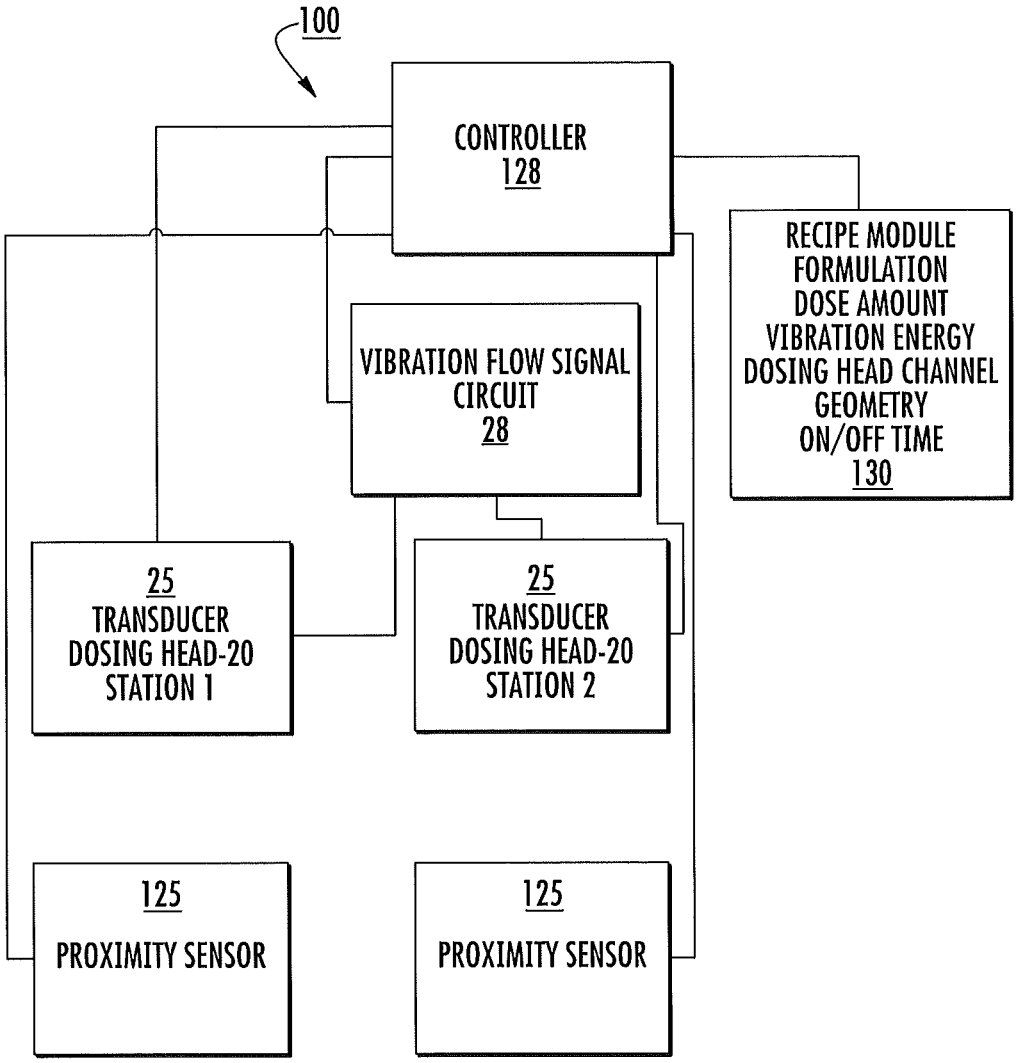
FIG. 13 is a control circuit diagram of a filling system according to embodiments of the present invention.

FIG. 13 is an exemplary schematic of a filling system 100 that includes multiple dosing heads 20 and multiple transducers 25. As shown, the system 100 includes a vibration flow signal circuit 28 that includes or communicates with a controller 128. The controller 128 typically includes a digital signal processor and can include an HMI (Human Machine Interface) to allow a user to enter certain inputs. The controller 128 can include or communicate with a recipe module (computer program) 130. The recipe module 130 can be programmed with an electronic library of defined operating parameters correlated to a particular dry powder or product (e.g., a product name, powder formulation and/or desired dose amount). The recipe module can provide the system 100 with data regarding the proper setting of various components and allow the controller to implement these settings, e.g., vibration flow signal configuration, on/off time of the flow signal and, where used, the recipe can take into account a configuration of the dosing head for systems that allow for interchangeability of the dosing head 20 and/or dosing plate 20*p*.

The system 100 can also include proximity sensors 125 or other sensors that provide feedback on the position of the dose containers which can be electronically monitored to facilitate the timing of the on-off flow signal for automated filling.

Figure 14:
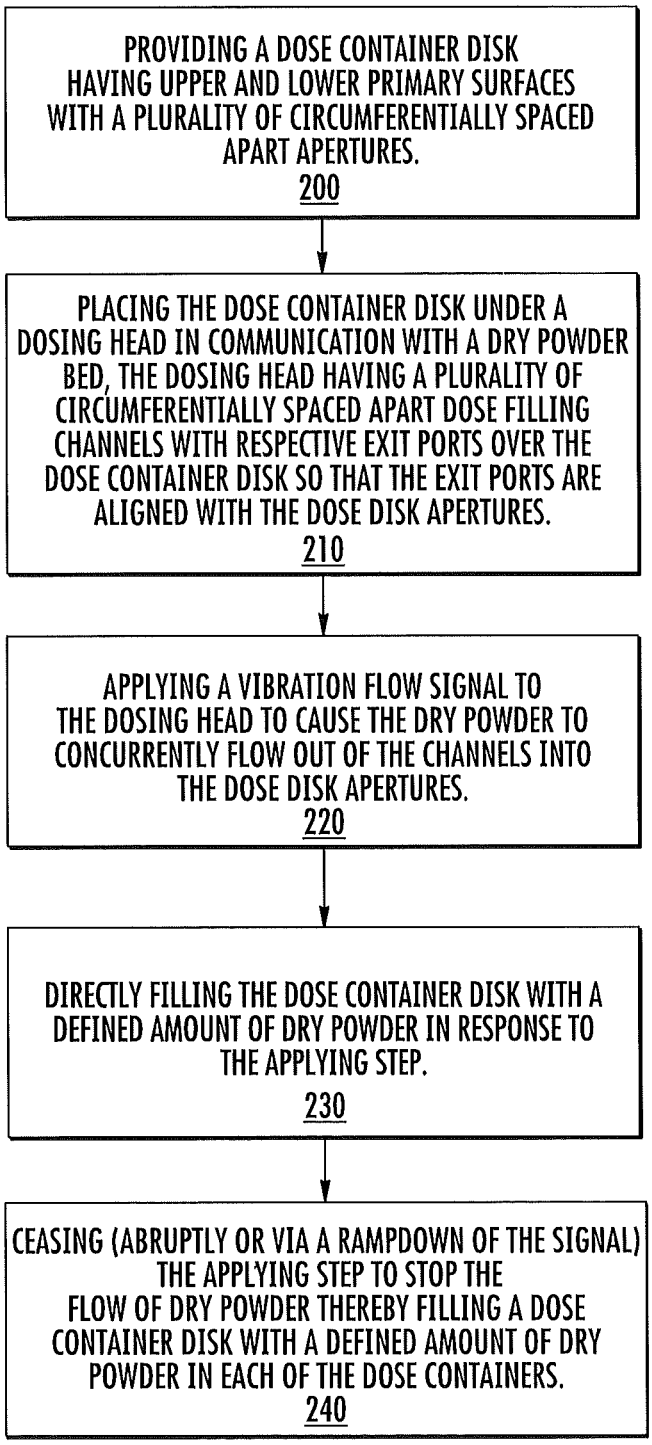
FIG. 14 is a flow chart of operations that can be used to fill at least one dose container member with multiple dose containers according to some embodiments of the present invention.

FIG. 14 is an exemplary flow chart of a method that can be used to carryout embodiments of the invention. The method includes providing a dose container disk having upper and lower primary surfaces with a plurality of circumferentially spaced apart apertures associated with dose containers (block 200). The dose container disk can be placed under a dosing head that resides below a dry powder bed, the dosing head having a plurality of circumferentially spaced apart dose filling channels with respective exit ports over the dose container disk so that the exit ports are aligned with the dose disk apertures (block 210). A vibration flow signal is applied to the dosing head to cause the dry powder to concurrently flow out of the channels into the dose disk apertures (block 220). The dose container disk is directly filled with a defined amount of dry powder in response to the applying step (block 230). The applying step is ceased (abruptly or via a ramp down of the signal) to stop the flow of dry powder thereby filling a dose container disk with a defined amount of dry powder in each of the dose containers (block 240). The ramp down of the signal may allow for a more controlled powder flow stoppage.

Figure 15:
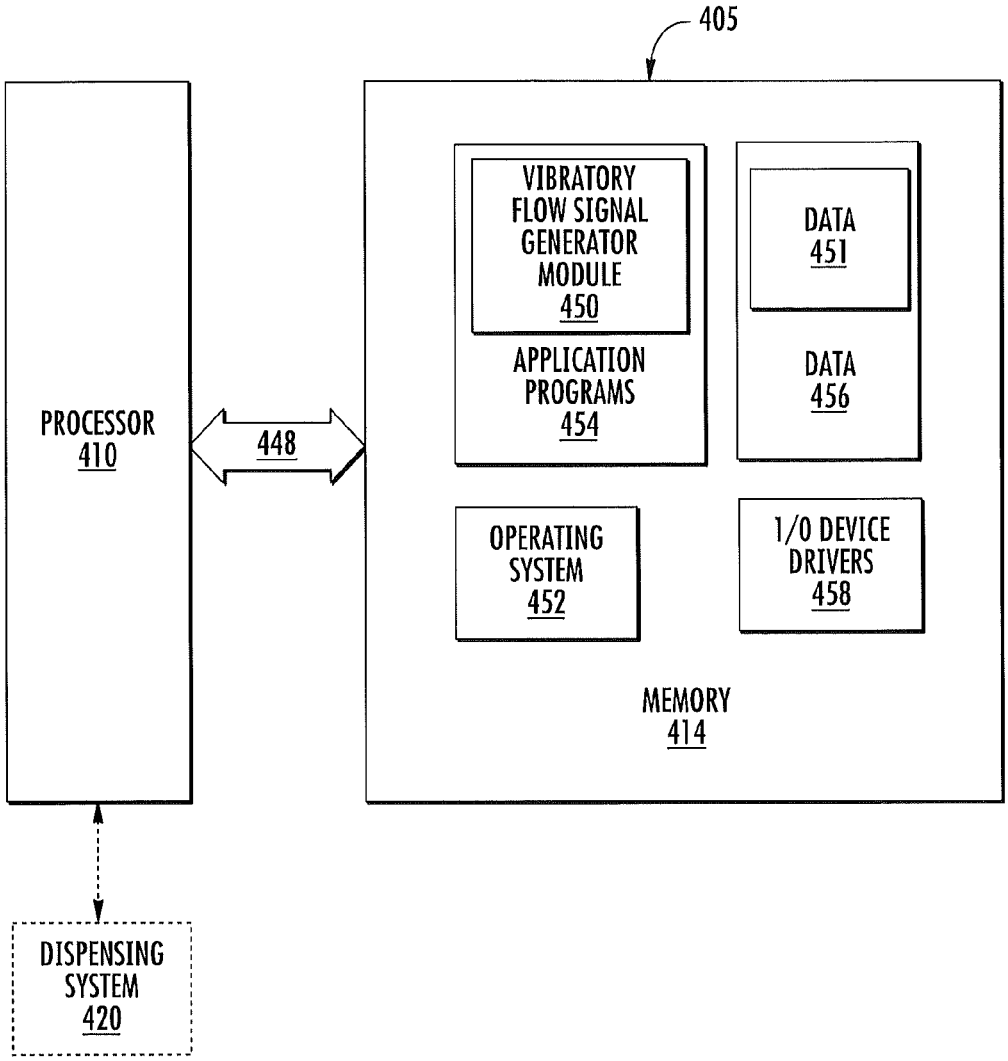
FIG. 15 is a schematic illustration of a data processing system according to embodiments of the present invention.

FIG. 15 is a block diagram of exemplary embodiments of data processing systems that illustrates systems, methods, and computer program products in accordance with embodiments of the present invention. The processor 410 communicates with the memory 414 via an address/data bus 448. The processor 410 can be any commercially available or custom microprocessor. The memory 414 is representative of the overall hierarchy of memory devices containing the software and data used to implement the functionality of the data processing system 405. The memory 414 can include, but is not limited to, the following types of devices: cache, ROM, PROM, EPROM, EEPROM, flash memory, SRAM, DRAM and magnetic hard drives.

As shown in FIG. 15, the memory 414 may include several categories of software and data used in the data processing system 405: the operating system 452; the application programs 454; the input/output (I/O) device drivers 458; the vibratory signal generator module 450; and the data 456. The data 456 may include a plurality of dry powder data 451 corresponding to particular recipes with operating parameters for each dry powder or product, which may be obtained from an operator or stored by the dispensing system 420 and/or timing data that defines the meted dose amounts, flow rates, and flow signal "on" time for the dispensing port (allowing automatic control of the dispensing operation). As will be appreciated by those of skill in the art, the operating system 452 may be any operating system suitable for use with a data processing system, such as OS/2, AIX, OS/390 or System390 from International Business Machines Corporation, Armonk, N.Y., Windows CE, Windows NT, Windows95, Windows98, Windows2000, WindowsXP and WindowsVista, from Microsoft Corporation, Redmond, Wash., Unix or Linux or FreeBSD, Palm OS from Palm, Inc., Mac OS from Apple Computer, LabView, or proprietary operating systems. The I/O device drivers 458 typically include software routines accessed through the operating system 452 by the application programs 454 to communicate with devices such as I/O data port(s), data storage 456 and certain memory 414 components and/or the dispensing system 420.

The application programs 454 are illustrative of the programs that implement the various features of the data processing system 405 and preferably include at least one application which supports operations according to embodiments of the present invention. Finally, the data 456 represents the static and dynamic data used by the application programs 454, the operating system 452, the I/O device drivers 458, and other software programs that may reside in the memory 414.

While the present invention is illustrated, for example, with reference to the signal generator module 450 being an application program in FIG. 15, as will be appreciated by those of skill in the art, other configurations may also be utilized while still benefiting from the teachings of the present invention. For example, the module 450 may also be incorporated into the operating system 452, the I/O device drivers 458 or other such logical division of the data processing system 405. Thus, the present invention should not be construed as limited to the configuration of FIG. 15, which is intended to encompass any configuration capable of carrying out the operations described herein.

The I/O data port can be used to transfer information between the data processing system 405 and the dispensing system 420 or another computer system or a network (e.g., an intranet and/or the Internet) or to other devices controlled by the processor. These components may be conventional components such as those used in many conventional data processing systems which may be configured in accordance with the present invention to operate as described herein.

While the present invention is illustrated, for example, with reference to particular divisions of programs, functions and memories, the present invention should not be construed as limited to such logical divisions. Thus, the present invention should not be construed as limited to the configuration of FIG. 15 but is intended to encompass any configuration capable of carrying out the operations described herein.

The flowcharts and block diagrams of certain of the figures herein illustrate the architecture, functionality, and operation of possible implementations of dry powder-specific dispensing and/or vibratory energy excitation means according to the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order, depending upon the functionality involved.

In certain embodiments, the present invention can provide computer program products for operating a flowing dry powder dispensing system having channels 20*ch* and a vibration energy source associated therewith to facilitate controlled flow. The computer program product can include a computer readable storage medium having computer readable program code embodied in the medium. The computer-readable program code can include: (a) computer readable program code that a plurality of different vibration energy signals associated with a "recipe" that correlates the formulation to the dosing head/dosing plate geometry and/or dose container geometry; and (b) computer readable program code that directs the dispensing system to operate using the vibration energy signal for defined "on" and "off" times to dispense the desired dose amount (at the desired flow rate).

The invention will now be described in more detail in the following non-limiting example.

EXAMPLE

"On/off" flow control evaluation data was obtained using a laboratory system. To deliver the vibratory signal, the laboratory system included a harmonic signal drive configuration with a HP33120A function generator that can provide a carrier signal source connected to a timer (such as a Panasonic LT4H timer) to gate the drive signal, connected to a power amplifier connected to an electromagnetic (linear) actuator from Ling Dynamic Systems, model number V203. Preliminary results indicate relatively limited powder bed depth sensitivity, at least between about 3 mm to about 6 mm of initial bed depth. Powder bed depth for most trials was set to 6 mm and replenished if dropped below about 3 mm for a particular trial.

Figure 16:
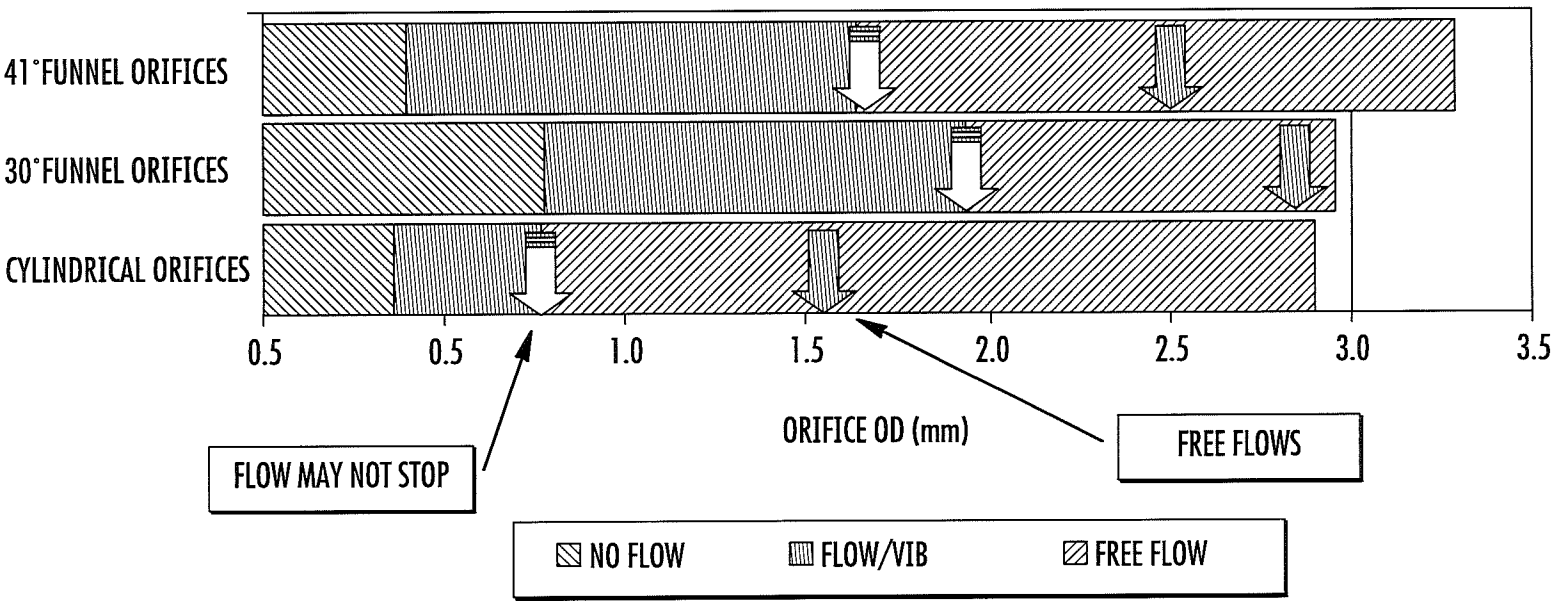
FIG. 16 is a graph showing data for flow channels with different geometries and "no flow", "flow with vibration" and "free flow" limits with respect to channel outer diameter sizes (mm) and minimum displacement.

FIG. 16 is a graph showing flow channels with different geometries and no flow, flow with vibration and free flow limits with respect to channel outer diameter sizes (mm) and minimum displacement to cause flow for inh230 dry powder. The flow start/stop control with the plate vibration was observed for a range of about 0.4 mm displacement for 1.5 mm deep cylindrical channels. Flow start/stop with the plate vibration was observed at about 1.0 mm displacement for funnel shaped channels. It is noted that even at the minimum displacement threshold to induce flow through a channel, sporadic stopping of the flow sets the upper size limit of the channel. The OD (outer diameter) measurement was taken at the bottom of the plate, e.g., at the exit port/opening.

Figures 17A, 17B, 17C, 17D:
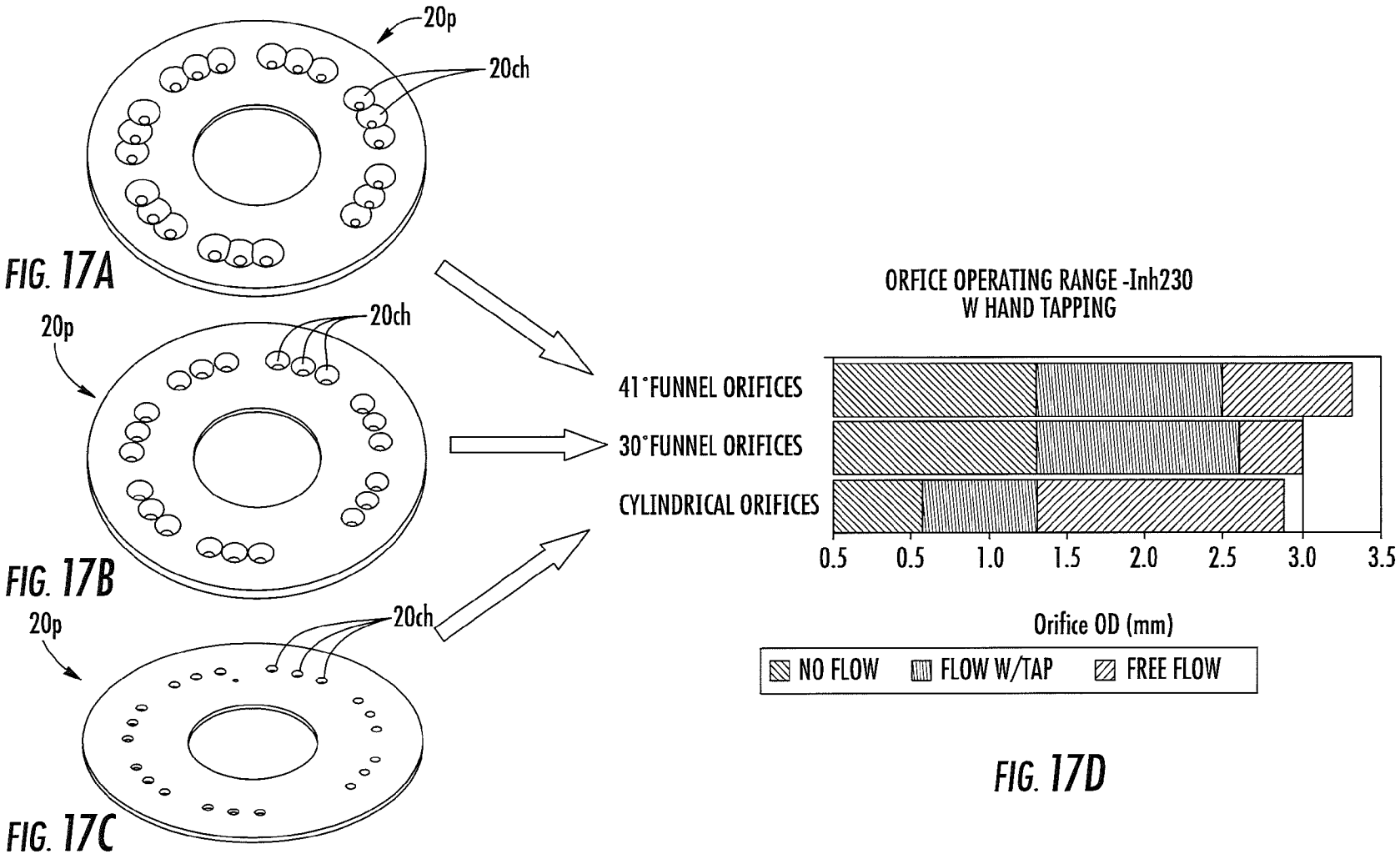
FIG. 17A is a top perspective view of a plate with about 41 degree funnel shaped channels.
FIG. 17B is a top perspective view of a plate with about 30 degree funnel shaped channels.
FIG. 17C is a top perspective view of a plate with substantially cylindrical (vertical) channels.
FIG. 17D is a graph of flow of Inh230 dry powder with "hand tapping", "no flow" and "free flow" with respect to channel size (OD) for different geometry dosing flow channels.

FIG. 17A is a top perspective view of a plate 20*p* with about 41 degree funnel shaped channels 20*ch*. FIG. 17B is a top perspective view of a plate 20*p* with about 30 degree funnel shaped channels 20*ch*. FIG. 17C is a top perspective view of a plate 20*p* with substantially cylindrical (vertical) channels. FIG. 17D illustrates flow of inh230 dry powder with hand tapping, no flow and free flow with respect to channel size (OD) measured at the exit port and geometry.

Figure 18:
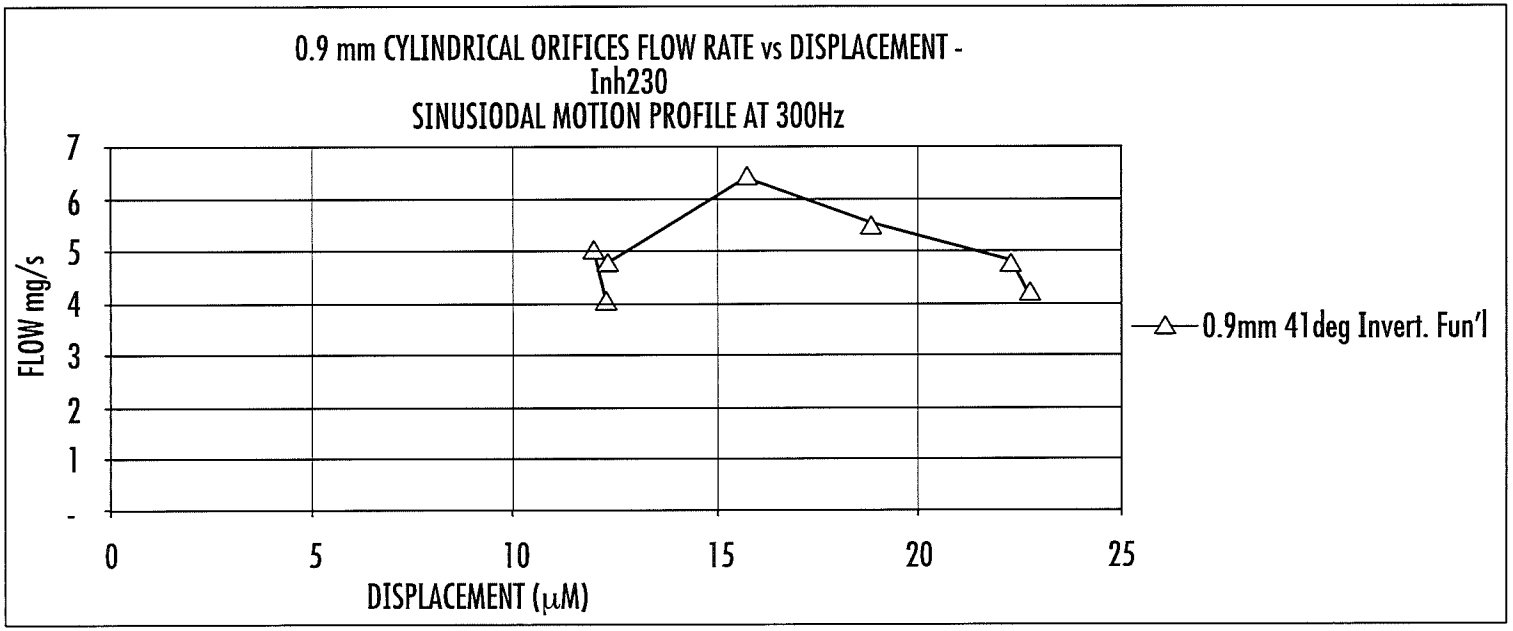
FIG. 18 is a graph of flow (mg/second) versus displacement (microns) for a 0.9 mm, 41 degree inverted funnel channel geometry.

FIG. 18 is a graph of flow (mg/second) versus displacement (microns) for a 0.9 mm, 41 degree inverted funnel. The 0.9 mm measurement with respect to the funnel refers to the exit port (the smaller orifice of the funnel shape) and with respect to the inverted funnel refers to the entry port or orifice (also the smaller orifice of the "funnel" shape). As the displacement of the plate increased beyond the minimum threshold to induce flow, flow increases rapidly with displacement, then begins to decrease with further increases in displacement. Thus, smaller displacements can be more optimal for flow control and rate. This behavior may aid in selecting a vibration displacement operating point with reduced sensitivity of flow to displacement. It may be desirable to configure the vibration to cause displacement that is just under or approaching the peak flow.

Figure 19:
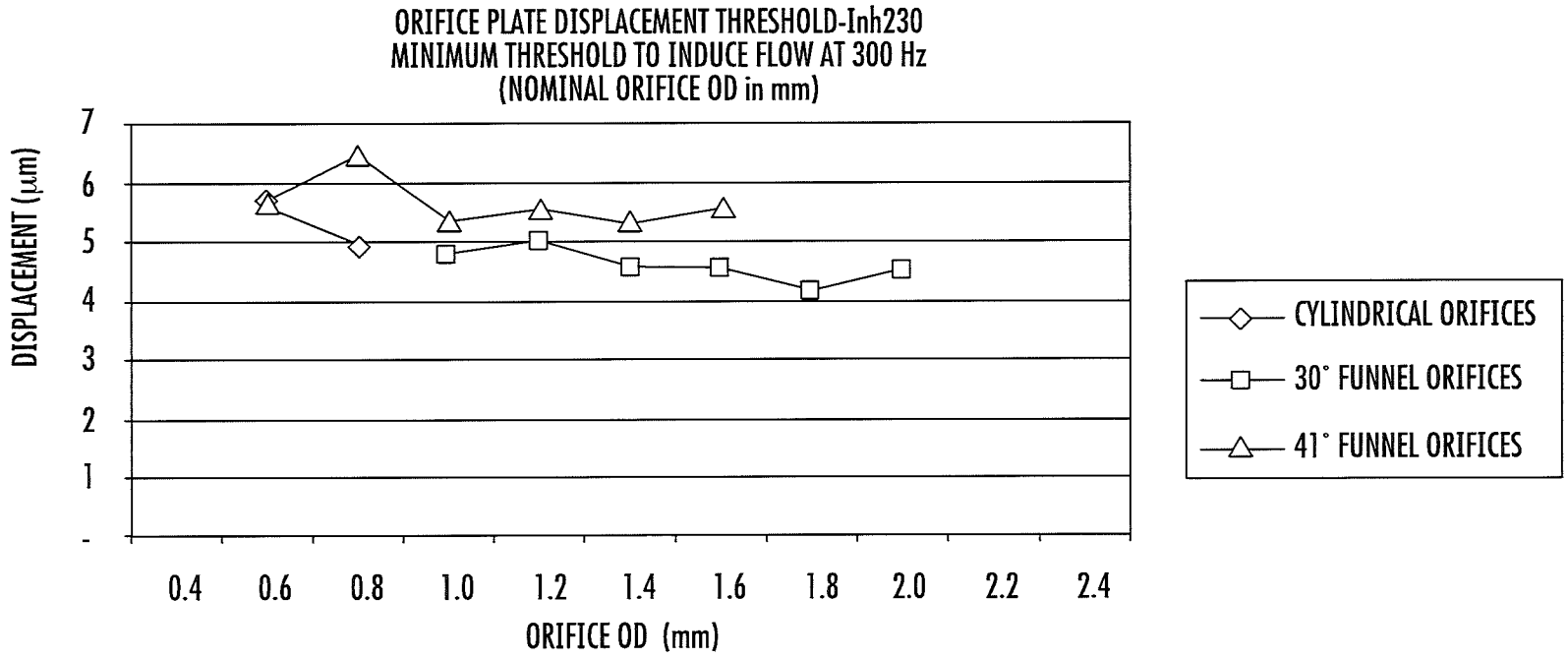
FIG. 19 is graph illustrating a minimum threshold displacement (microns/micrometers) to induce flow (at 300 Hz for Inh230) versus channel nominal outer diameter size (mm) for three different channel geometries, cylindrical, 30 and 41 degree funnels.

FIG. 19 illustrates a minimum threshold displacement (microns/micrometers) to induce flow (at 300 Hz for Inh230) versus channel nominal outer diameter size (mm) (at the exit port) for three different channel geometries (cylindrical, taken at two different small sizes), and 30 and 41 degree funnels. Over the exit port diameter of interest, the displacement threshold has little variation.

Figure 20B:
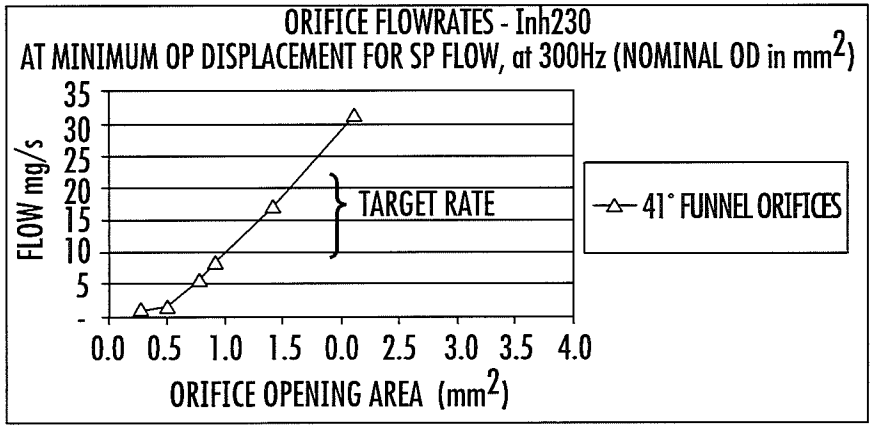
FIG. 20B is a graph of flow rate (mg/s) versus channel area ($mm^2$) for a 41 degree funnel.
Figure 20A:
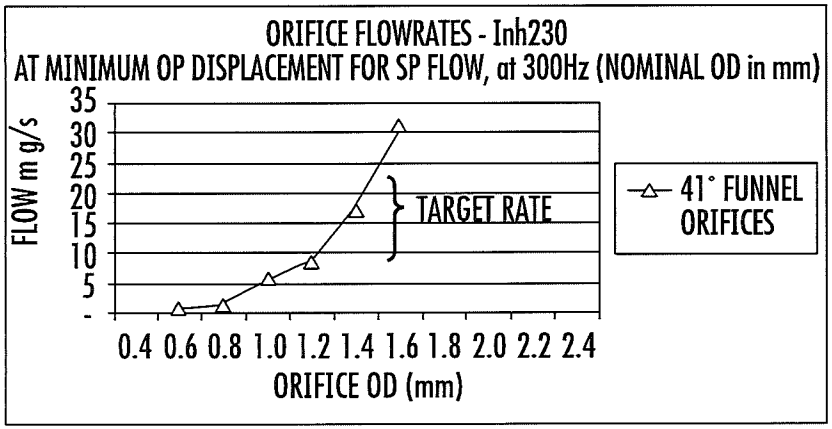
FIG. 20A is a graph of flow (mg/s) versus channel OD (nominal OD in mm at minimum displacement for flow using a 300 Hz vibratory signal for Inh230.
Figure 21A:
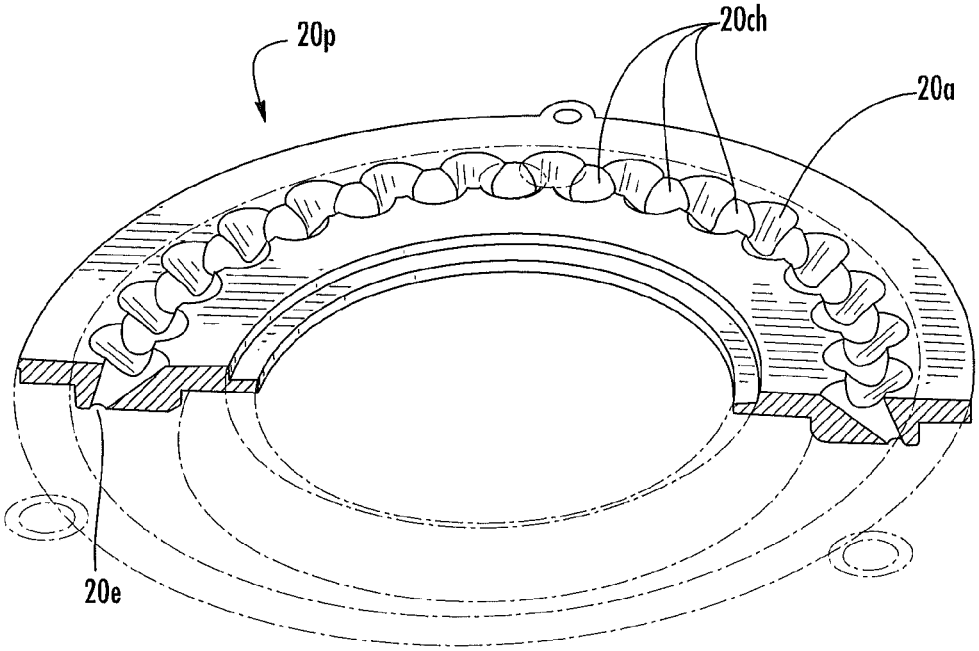
FIG. 21A is a top perspective cutaway view of a dosing head with alternating inward and outward sloping channels according to embodiments of the present invention.
Figure 21B:
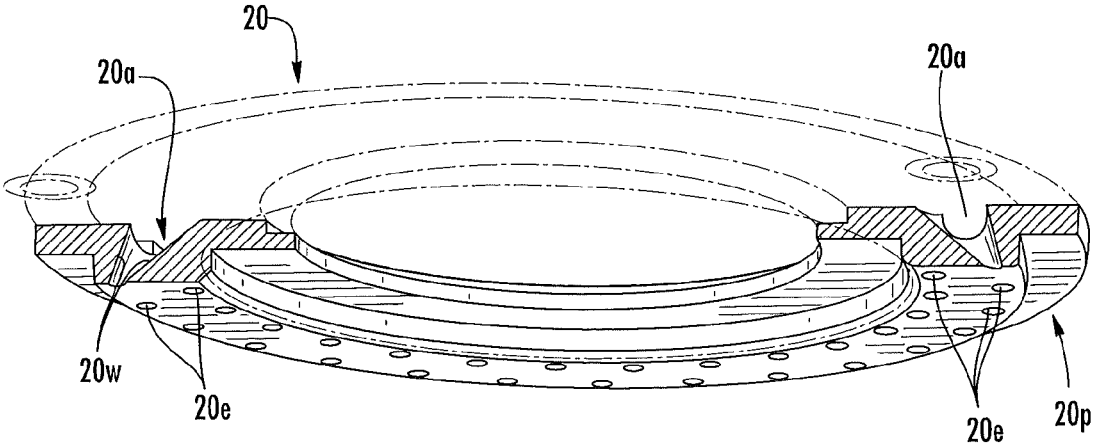
FIG. 21B is a bottom perspective cutaway view of the device shown in FIG. 21A.
Figure 21C:
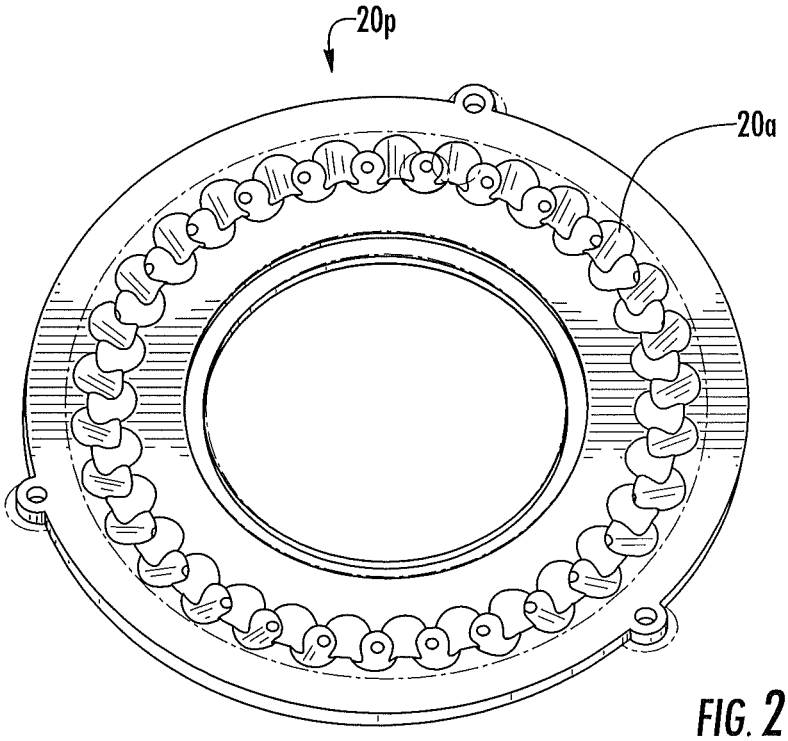
FIG. 21C is a top view of the device shown in FIG. 21A.
Figure 21D:
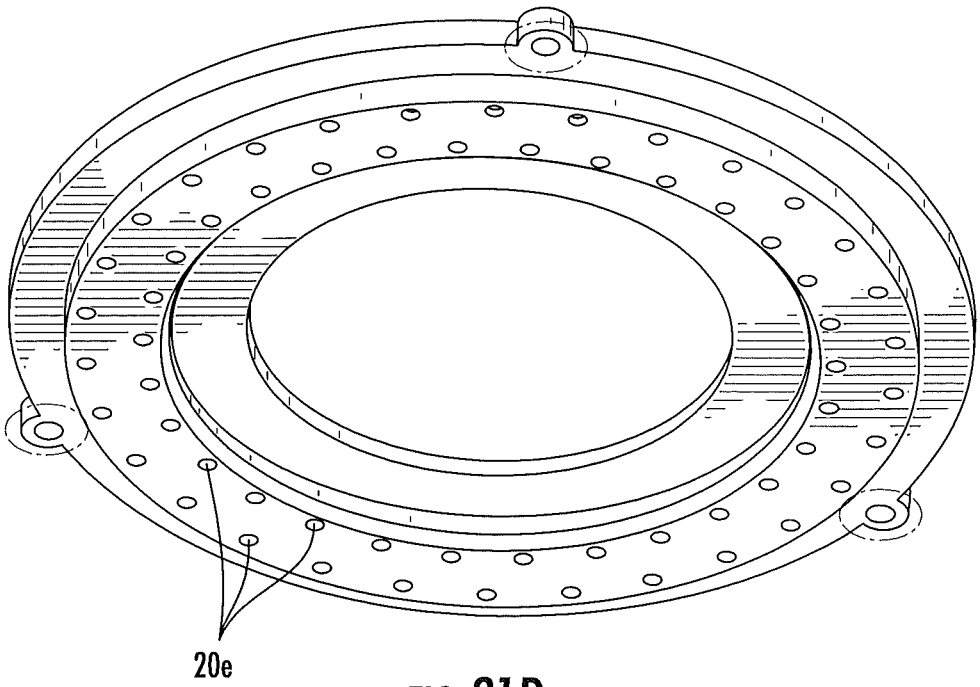
FIG. 21D is a bottom view of the device shown in FIG. 21A.

FIG. 20A is a graph of flow (mg/s) versus channel OD (nominal OD in mm at exit port) at minimum displacement for flow using a 300 Hz vibratory signal for Inh230.

FIG. 20B is a graph of flow rate (mg/s) versus channel area (mm 2) taken at the exit port for a 41 degree funnel. The target flow rate for sub-second filling operations of a dose ring or disk for Inh230 is shown as greater than 5 mg/s, typically between about 10-25 mg/s, which correlates to an opening size of about 2 $mm^2$ with about a 41 degree funnel channel geometry using the minimum displacement for flow and a flow signal of about 300 Hz. At the minimum displacement threshold, the 41 degree funnel geometry flow rate increase proportional to the area of the exit port.

The following exemplary claims are presented in the specification to support one or more devices, features, and methods of embodiments of the present invention.

While not particularly listed below, Applicant preserves the right to claim other features shown or described in the application.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An apparatus for dispensing a defined amount of dry powder concurrently to a plurality of spaced apart dose receiving containers, comprising:

a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head; and at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports, wherein the vibration source comprises a substantially cylindrical body actuator mechanism with a radially extending skirt having an array of circumferentially extending apertures extending therethrough, and wherein the apparatus further comprises a tube plate with an array of upwardly extending tubes having upper and lower ends, the tube plate positioned between the actuator body skirt and the dose head body so that upper ends of the tubes are in communication with dry powder in a dry powder hopper and lower ends of the tubes reside proximate the dosing head channels.

2. The apparatus of claim 1, wherein the spaced apart channels are arranged so that the respective exit ports are substantially circumferentially spaced apart in at least one circle.

3. The apparatus of claim 1, wherein the dosing head has at least 60 channels with the exit ports arranged in at least two substantially circular rows, and wherein the exit ports have a diameter of about 3 mm or less.

4. The apparatus of claim 1, wherein the channels are sloped along at least a major portion of the channel length.

5. The apparatus of claim 1, wherein the channels have at least one sidewall that slopes downward at an angle that is between about 30 degrees to about 70 degrees for at least a major portion of the length of the channel.

6. The apparatus of claim 1, wherein the channels have at least one sidewall that slopes downward at an angle that is between about 30 degrees to about 45 degrees for at least a major portion of the length of the channel.

7. The apparatus of claim 1, wherein the channels have at least one sidewall that slopes downward at an angle that is about 41 degrees for at least a major portion of the length of the channel.

8. The apparatus of claim 1, wherein the entry port of the respective channels has a cross-sectional area that is smaller than a cross-sectional area of the corresponding exit port.

9. The apparatus of claim 1, wherein the entry port of the respective channels have a cross-sectional area that is larger than a cross-sectional area of the corresponding exit port.

10. The apparatus of claim 1, wherein the channels comprise at least a portion with a funnel shape.

11. The apparatus of claim 1, wherein the channels comprise at least a portion with an inverted funnel shape so that the exit port is larger than the entry port.

12. The apparatus of claim 1, wherein the channels have a first portion that angles downwardly to merge into a second portion that is substantially vertical at the exit port.

13. The apparatus of claim 1, wherein the dosing head includes a plate that holds the channels.

14. The apparatus of claim 1, wherein the dosing head includes at least one substantially circular orifice plate that defines the channels, the plate having a center and wherein the apparatus further comprises a upstanding rod that is substantially aligned with the center of the plate, wherein the rod is in communication with the plate and the vibration source and is configured to apply the vibration flow signal to the plate dosing channels.

15. The apparatus of claim 1, wherein the vibration source is substantially in-line with a vertical axis associated with a center of the dosing head and is configured to apply the vibratory signal with sufficient energy so that the dosing head has a vertical displacement that is less than about 25 microns, and wherein the target dose container is a disk that is closely spaced apart from a lowermost surface of the dosing head during filling.

16. An apparatus for dispensing a defined amount of dry powder concurrently to a plurality of spaced apart dose receiving containers, comprising, a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head; and at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports, wherein the dosing head channel exit ports are arranged in first and second rows of substantially concentric circles, wherein the first row of exit ports have radially extending centerlines that are offset circumferentially from radially extending centerlines of the second row of exit ports, and wherein the channels are configured to have alternating inwardly and outwardly sloping channels.

17. The apparatus of claim 16, wherein an exit port on the first row and a neighboring exit port on the second row define respective pairs of adjacent exit ports, and wherein the corresponding entry ports of the pairs of exit ports overlap.

18. An apparatus for dispensing a defined amount of dry powder concurrently to a plurality of spaced apart dose receiving containers, comprising:

a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head; and at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports, wherein the channels have a geometry that defines a miniature-hopper that holds a plurality of bolus amounts of dry powder, wherein the geometry and vibratory signal are selected to provide an on off flow pattern for a dry powder formulation to deliver a defined dose amount in the range of between about 0.5-15 mg in less than about 1 second, and wherein the dry powder bed resides in an unsealed, non-pressurized housing.

19. An apparatus for dispensing a defined amount of dry powder concurrently to a plurality of spaced apart dose receiving containers, comprising:

a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head;

at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports; and a substantially circular tube plate with an array of circumferentially spaced apart tubes, wherein the dosing head body is defined by a substantially circular orifice plate that includes at least one row of circumferentially spaced apart elongate channels, wherein the vibration source includes an actuator mechanism with a substantially cylindrical body with a vertically extending centerline aligned with a vertical linear vibration axis of the orifice plate, the actuator mechanism having a radially extending skirt that is attached to the orifice plate and the tube plate, and wherein the actuator mechanism comprises a plurality of linear actuators that cause the tubes to vibrate in a vertical direction to feed dry powder to the orifice plate and to apply the vibration signal to the orifice plate.

20. An apparatus for dispensing a defined amount of dry powder concurrently to a plurality of spaced apart dose receiving containers, comprising:

a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head; and at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports, wherein the vibration source comprises at least one of the following:

(a) a plurality of actuators, one residing proximate each dosing channel to individually apply the flow signal to a respective channel;

(b) a single actuator that is configured to apply the flow signal to all of the dosing channels; or (c) a plurality of actuators, at least one for sub-groupings of the dosing channels.

21. An apparatus for dispensing a defined amount of dry powder concurrently to a plurality of spaced apart dose receiving containers, comprising:

a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head; and at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports, wherein the dry powder bed comprises a dry powder having a pharmaceutically active agent, and wherein the agent comprises one or more of the following bronchodilators:

albuterol, salmeterol, ephedrine, adrenaline, fenoterol, formoterol, isoprenaline, metaproterenol, phenylephrine, phenylpropanolamine, pirbuterol, reproterol, rimiterol, terbutaline, isoetharine, tulobuterol, or (−)-4-amino-3,5-dichloro-α-[[6-[2-(2-pyridinyl) ethoxy]hexyl]methyl] benzenemethanol;

wherein the bronchodilator may be used in the form of salts, esters or solvates to thereby optimize the activity and/or stability of the medicament.

22. An apparatus for dispensing a defined amount of dry powder concurrently to a plurality of spaced apart dose receiving containers, comprising:

a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head; and at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports, wherein the dosing head comprises at least one plate that defines at least some of the channels, and wherein the dosing head is configured to releasably engage different plates having different channel geometries to thereby allow a user to dispense different dry powders.

23. An apparatus for dispensing a defined amount of dry powder concurrently to a plurality of spaced apart dose receiving containers, comprising:

a dosing head comprising a body with a plurality of spaced apart downwardly extending elongate channels having a channel length with an upper end defining an entry port and a lower end defining an exit port, wherein the channels are sized and configured to prevent a free flow of dry powder therefrom;

a dry powder bed residing above and in communication with the dosing head; and at least one vibration source in communication with the dosing head channels configured to controllably apply a vibration flow signal, wherein, in use, the vibration flow signal is applied to the dosing head channels for a defined time so that dry powder from the dry powder bed flows through the elongate channels and out the exit ports in a defined dose amount, and when the vibration flow signal is removed from the dosing head channels, dry powder does not flow out of the exit ports, wherein the channels communicate with dry powder in the dry powder bed to define miniature hoppers that each hold a plurality of bolus amounts of dry powder and controllably directly dispense a single bolus amount to an aligned dose container in response to an on and off application of the vibration flow signal to the dosing channels.

24. The apparatus of claim 23, wherein the dosing head is spaced apart a distance between about 0.1 mm to about 2.0 mm, wherein the vibratory source comprises a one-axis actuator positioned substantially in-line with a center of the dosing head, and wherein the apparatus includes a vibratory control circuit with a controller and a timer in communication with the actuator to electronically control the defined time that the vibration flow signal is applied, and wherein the defined time is less than about 1 second.

* * * * *

UNITED STATES PATENT AND TRADEMARK OFFICE

CERTIFICATE OF CORRECTION

PATENT NO. : 8,720,497 B2
APPLICATION NO. : 13/029356
DATED : May 13, 2014
INVENTOR(S) : Meckstroth et al.

It is certified that error appears in the above-identified patent and that said Letters Patent is hereby corrected as shown below:

In the SPECIFICATION:

Column 2, Line 37: Please begin a new paragraph after "channels." in Line 37 so that it reads:

-- channels.

In some embodiments, --

Column 15, Line 10: Please begin a new paragraph after "herein." in Line 10 so that it reads:

-- herein.

The dosing head 20 can --

Signed and Sealed this
Thirteenth Day of January, 2015

Michelle K. Lee

Michelle K. Lee
*Deputy Director of the United States Patent and Trademark Office*